US005529646A

United States Patent [19]

Nakajima et al.

[11] Patent Number: 5,529,646

[45] Date of Patent: Jun. 25, 1996

[54] PROCESS OF PRODUCING HIGH-FORMABILITY STEEL PLATE WITH A GREAT POTENTIAL FOR STRENGTH ENHANCEMENT BY HIGH-DENSITY ENERGY

[75] Inventors: Hiroki Nakajima, Toyota; Yoshirou Tomioka, Anjo; Yutaka Suzuki, Toyota; Shinichirou Nakamura, Nagoya; Kouichi Makii, Kakogawa; Tetsuo Soshiroda, Kakogawa; Tomohiro Kase, Kakogawa; Yoshinobu Omiya, Kakogawa; Yoshiki Tanaka, Kakogawa, all of Japan

[73] Assignees: Toyota Jidosha Kabushiki Kaisha, Toyota; Kabushiki Kaisha Kobe Seiko Sho, Kobe, both of Japan

[21] Appl. No.: 308,611

[22] Filed: Sep. 19, 1994

Related U.S. Application Data

[63] Continuation of Ser. No. 111,606, Aug. 25, 1993, abandoned.

[30] Foreign Application Priority Data

| | | | |
|---|---|---|---|
| Aug. 28, 1992 | [JP] | Japan | 4-230569 |
| Aug. 28, 1992 | [JP] | Japan | 4-230570 |
| Aug. 28, 1992 | [JP] | Japan | 4-230574 |
| Aug. 28, 1992 | [JP] | Japan | 4-230575 |
| Aug. 28, 1992 | [JP] | Japan | 4-230576 |
| Aug. 28, 1992 | [JP] | Japan | 4-230577 |

[51] Int. Cl.[6] ..... C21D 1/09

[52] U.S. Cl. ..... 148/565; 148/525

[58] Field of Search ..... 148/525, 565

[56] References Cited

U.S. PATENT DOCUMENTS

| | | | |
|---|---|---|---|
| 4,501,626 | 2/1985 | Sudo et al. | 148/320 |
| 5,022,936 | 6/1991 | Tsujimura et al. | 148/565 |
| 5,200,005 | 4/1993 | Najah-Zadeh et al. | 148/320 |

FOREIGN PATENT DOCUMENTS

| | | | |
|---|---|---|---|
| 295500 | 12/1988 | European Pat. Off. | 148/320 |
| 2124041 | 11/1972 | Germany | 148/565 |
| 50-97506 | 8/1975 | Japan | 148/565 |
| 56-156717 | 12/1981 | Japan | 148/320 |
| 57-70238 | 4/1982 | Japan . | |
| 61-99629 | 5/1986 | Japan . | |
| 61-261462 | 11/1986 | Japan . | |
| 62-20820 | 1/1987 | Japan | 148/320 |
| 62-23924 | 1/1987 | Japan | 148/565 |
| 62-70515 | 4/1987 | Japan | 148/565 |
| 63-53210 | 3/1988 | Japan | 148/565 |
| 1-259118 | 10/1989 | Japan . | |
| 1316423 | 12/1989 | Japan | 148/565 |
| 4-72010 | 3/1992 | Japan . | |

*Primary Examiner*—Deborah Yee

*Attorney, Agent, or Firm*—Oblon, Spivak, McClelland, Maier, & Neustadt

[57] ABSTRACT

Disclosed are alloying elements and microstructures suited for realizing a marked increase in strength of low-carbon or ultra-low-carbon steel plate using a high-density energy source such as a laser. Steel blanks satisfying both high formability and high strength requirements are provided which show sufficient press formability and yet can be markedly increased in strength by laser treatment or which have been markedly increased in strength by laser treatment in areas not to be subjected to severe forming.

34 Claims, 21 Drawing Sheets

PROCESS OF PRODUCING HIGH-FORMABILITY STEEL PLATE WITH A GREAT POTENTIAL FOR STRENGTH ENHANCEMENT BY HIGH-DENSITY ENERGY

This application is a continuation of application Ser. No. 08/111,606, filed on Aug. 25, 1993, now abandoned.

BACKGROUND OF THE INVENTION

The present invention relates to a steel plate showing good formability in the forming stage and yet providing for excellent strength in use. More particularly, the invention relates to a highly formable steel plate which can be enhanced in strength in necessary areas by high-density energy treatment after forming or a steel plate which has been enhanced in strength in preselected not-severely-forming areas by said high-density energy treatment and can, therefore, be easily formed. In the following description of the invention, the post-forming laser treatment mode of the invention will be chiefly described but as pointed out above, the laser treatment according to the invention can be performed prior to forming as well. Similarly, the application of the invention to automotive body members will be described as a typical application but the scope of the invention is not limited to such particular application but covers a variety of applications demanding the above-mentioned two requirements, viz. formability and increased strength.

Automotive parts, particularly body members, are required to satisfy two conflicting requirements, viz. ease of forming and high strength. Thus, such members must have high formability in order that they may fit neatly to the streamlined contour of a car body and, at the same time, should have been highly increased in strength in strategical areas so that adequate protection may be afforded to the passenger in the event of, for example, a collision on the road. Therefore, the technology of press-forming a highly formable low-carbon steel blank and increasing its strength in predetermined regions with a high-density energy source has been proposed (cf. Japanese Tokkyo Kokai Koho S-61-99629). However, when such a blank is irradiated using a high-density energy source, for example a laser, under the conditions described in the patent specification referred to above, an uneven penetration of heat across the thickness of the plate tends to cause a strain, thus necessitating reshaping following laser treatment. Moreover, the required number of laser scan lines is considerably increased to cause a practically unacceptable protraction of treating time.

This technology based on the concept of laser hardening after press-forming is such that a blank is first press-formed in a press line and then exposed to a high-density energy but the research so far undertaken has generated no information at all about what is the optimum combination of material steel microstructure and high-density energy treatment parameters that would minimize said strain or whether such combination would lead to a sufficient enhancement of strength. Therefore, a great demand exists for the generation of information on the optimum combination of high-density energy treatment parameters and steel microstructure. Thus, the development, based on the knowledge of steel microstructure, of a steel blank which would be easily formable in the press-forming stage and could then be enhanced in strength after forming has been awaited.

Aside from the above technology, Japanese Tokkyo Kokai Koho H-4-72010 discloses a process comprising exposing a press-formed member to laser light to achieve an enhancement of strength. This patent specification states that such increases in strength can be obtained by subjecting carbon steel plate to laser treatment. However, as regards the composition of steel, this prior art refers only to the amount of carbon and does not refer to alloying elements other than carbon, nor does it refer to the microstructure of steel. Therefore, no information is available from this literature on the correlation of alloying elements and steel microstructure with laser treatment parameters. The research done by the inventors of the present invention revealed that the enhancement of strength due to laser treatment is dependent not only on laser parameters but also, significantly, on the alloying elements and microstructure of steel. Therefore, in order to realize a useful increase in strength by laser treatment, it was considered essential to elucidate the above-mentioned correlation.

In this connection, Japanese Tokkyo Kokai Koho S-61-261462 provides some information on a formable steel plate for laser treatment use but the formability discussed there is the press-formability of laser-cut steel. In contrast, the present invention is directed to laser hardening and although the same term 'laser treatment' is used, the invention is quite different from the above technology in that it is not directed to steel cutting.

Furthermore, Japanese Tokkyo Kokai Koho H-1-259118 discloses a technology for achieving an increase steel strength which comprises subjecting strength-required zones of a press-formed material to rapid remelting-rapid solidification treatment to locally induce formation of microfine crystal grains. However, this laid-open patent specification is directed to a selective melting of the zone which would constitute the reverse side in use and unlike the through-melting technology of the present invention, it produces a large residual strain and, moreover, does not provide a sufficient increase in strength. Moreover, the mechanism of strength enhancement in the above technology resides in a decreased size of crystal grains and not in hardening. In this respect, too, this prior art technology should be differentiated from the present invention whose mechanism is concerned with the formation of a hardened microstructure.

Still further Japanese Tokkyo Kokai Koho S-57-70238 discloses a method of hardening treatment, but does not refer to chemical composition of the mother steel.

It is, therefore, clear that the hitherto-known processes are fundamentally different from the process of the invention which is described in detail herein-after.

SUMMARY OF THE INVENTION

The inventors of the present invention discovered, after an intensive exploration into the influence of alloying species and microstructure of steel on the effect of high-density energy treatment, that several desirable characteristics which had never been realized in the conventional steels are implemented under definite high-density energy treatment conditions when the alloying elements of steel are controlled within certain limits and the steel microstructure for each specified alloy composition is also definitely controlled. The present invention is based on the above findings.

The steel plate according to the present invention exhibits excellent formability on the one hand and, when subjected to high-density energy treatment for creating a solidification zone extending through its thickness, exhibits a remarkably increased strength on the other hand, with the result that it can be used in an expanded variety of uses. In other words, it is a high-formability steel plate with a great potential for strength enhancement.

The high-formability steel plate of the present invention includes both low-carbon and ultra-low-carbon steel species. The low-carbon steel plate of the invention is first described. This steel plate is characterized, in alloy composition, by comprising

C: 0.02~0.3%

Si: not more than 3.0% and preferably not more than 1.5%

Mn: not more than 2.5% and preferably 0.3~2.5%, with Fe and unavoidable impurity accounting for the balance and, in microstructure, by either

- a structure predominantly composed of ferrite and bainite [hereinafter referred to sometimes as (F+B)],
- a structure composed predominantly of ferrite and perlite (and/or cementite) [hereinafter referred to sometimes as (F+P/C)],
- a structure composed predominantly of ferrite and martensite [hereinafter referred to sometimes as (F+M)] (which is a substantially biphasic structure), or
- a structure containing either one or both of martensite and bainite in addition to ferrite and residual austenite [hereinafter referred to sometimes as (F+γ+M/B)] or containing martensite, bainite and ferrite [hereinafter referred to sometimes as (M+B+F) (which are substantially triphasic or quadriphasic).

The fundamental alloy composition of the low-carbon steel according to the present invention is as described above. However, it has been found that the $K_1$ value which can be calculated by the following equation using the amounts of C, Si and Mn has important bearings on good formability prior to laser treatment and on high strength after laser treatment.

$$K_1=(Mn\%+0.25.Si\%)\times C\%$$

Thus, it has been discovered that low-carbon steel plates having $K_1$ values not less than 0.1 in the case of (F+B), (F+M) or (M+B+F), those with $K_1$ values not less than 0.01 (preferably not less than 0.05) in the case of (F+P/C), and those with $K_1$ values not less than 0.35 in the case of (F+γ+M/B) are more positively meritorious in both of said high formability prior to laser treatment and said high strength after laser treatment.

The low-carbon high-formability steel plates according to the present invention may contain, in addition to C, Si and Mn, one or more of the following species as essential alloying elements within the indicated ranges.

Cr: not more than 2.5%

Mo: not more than 1.0%

B: not more than 50 ppm

However, for the calculation of $K_1$ in cases where such additional alloying elements are used, the following equation is used to determine $K_2$.

$$K_2=(Mn\%+Cr\%+Mo\%+250.B\%+0.25.Si\%)\times C\%$$

As will be seen from the above equations, the $K_2$ value is slightly larger than the $K_1$ value on account of addition of Cr, Mo and/or B but as a rule the $K_2$ value thus calculated is also subject to the lower limit mentioned above for $K_1$ and particularly in the case of (F+P/C), the $K_2$ value is preferably not less than 0.05.

Furthermore, the low-carbon high-formability steel plates of the invention, regardless of the different microstructures described above, may contain, in addition to Cr, Mo and B mentioned above, one or more of the following alloying species within the indicated ranges.

Cu: not more than 2.5%

Ni: not more than 1.5%

P: not more than 0.15%

Nb: not more than 0.2%

Ti: not more than 0.2%

Zr: not more than 0.1%

V: not more than 0.1%

W: not more than 0.1%

Now, the ultra-low-carbon steel plates of the invention are described. In alloy composition, these steels comprise

C: 0.002~0.02%

Si: not more than 2.0%

Mn: not more than 0.1~2.5% and preferably 1.2~2.5% with Fe and unavoidable impurity accounting for the balance. Regarding the microstructures of these steels, ferrite accounts for a predominant proportion.

While the fundamental alloy composition of the ultra-low-carbon steels of the invention is described above, steels further containing, in addition to said essential alloying elements of C, Si and Mn, one or more of the following alloying elements within the following ranges (A)

Ti: not more than 0.1%

Nb: not more than 0.1% and steels containing one or more of the following species as alloying elements within the following ranges (B)

P: 0.06~0.2%

B: not more than 50 ppm are also subsumed in the concept of the ultra-low-carbon steels according to the present invention.

In steel (B), however, it is essential that the T value given by the following equation be not less than 0.01.

$$T=(Mn\%+20.P\%+250.B\%+0.25.Si\%)\times C\%$$

The ultra-low-carbon steel (C) of the present invention is characterized in that the lower limit values for C and Mn are slightly increased. Thus, the ultra-low-carbon steel (C) of the invention comprises

C: 0.005~0.02%

Si: not more than 2.0%

Mn: 1.2~2.5%

P: 0.06~0.2%

B: not more than 50 ppm and

T: 0.01–0.1%

Nb: not more than 0.005~0.1%, with the T value given by the above equation being not less than 0.01.

Further, an ultra-low-carbon steel (D) of the invention comprises

C: 0.002~0.02%

Si: not more than 2.0%

Mn: 0.1–2.5%, and one species selected from among

Cu: not more than 2.5%

Ni: not more than 1.5%

Cr: not more than 2.5%

Mo: not more than 1.0%

P: not more than 0.15%

B: not more than 50 ppm

Nb: not more than 0.1%

Ti: not more than 0.1%

Zr: not more than 0.1%

V: not more than 0.1%

W: not more than 0.1%

An ultra-low-carbon steel (E) of the invention corresponds to said steel (D) except that Nb and Ti are included as essential elements. In this steel (E), the Ti and Nb contents are defined to be not more than 0.1% and not more than 0.1%, respectively.

BRIEF DESCRIPTION OF THE DRAWINGS

The conditions of irradiation with a high-density energy source are first explained. While the use of a laser as the high-density energy source is described below, a plasma or the like can also be employed in place of a laser. In the first place, the relationship between laser parameters and gain in strength was explored in low-carbon steel. FIG. 1 shows the relation of varying laser parameters with gains in strength of testpieces (1.4 mm thick) of a low-carbon steel comprising 0.10% of C, 0.01% of Si, 0.90% of Mn, 0.032% of Al (added as a deoxidizer and regarded as unavoidable impurity) and the balance of Fe and unavoidable impurity (other than Al). It is apparent from FIG. 1 that when the laser emission is controlled to give an energy density of not less than 100 $J/mm^2$, a remarkable increase in strength is realized. This high-density emission insures a molten zone penetrating through the thickness of the testpiece and a remarkable gain in strength is realized only when the above condition is satisfied. Moreover, this condition prevents straining in the thickness direction to help minimize the residual strain after forming.

Then, the relationship between laser parameters and gain in strength in ultra-low-carbon steel was investigated in the same manner as in the case of FIG. 1. Thus, FIG. 2 shows the relations of various laser parameters with gains in strength of testpieces (1.4 mm thick) of an ultra-low-carbon steel comprising 51 ppm of C, 0.99% of Mn, 0.053% of Ti, 0.029% of Al (added as a deoxidizer and regarded as unavoidable impurity) and the balance of Fe and unavoidable impurity (other than Al). The results showed that just like the case diagrammatically shown in FIG. 1, a remarkable gain in strength was obtained when the laser was controlled to provide an energy density of not less than 100 $J/mm^2$.

As mild steel materials for cold forming, (F+P) low-carbon steels are generally utilized but when a still more mild steel material is desired, a steel with a coarse spheroidized cementite structure is selected.

Figure 1:
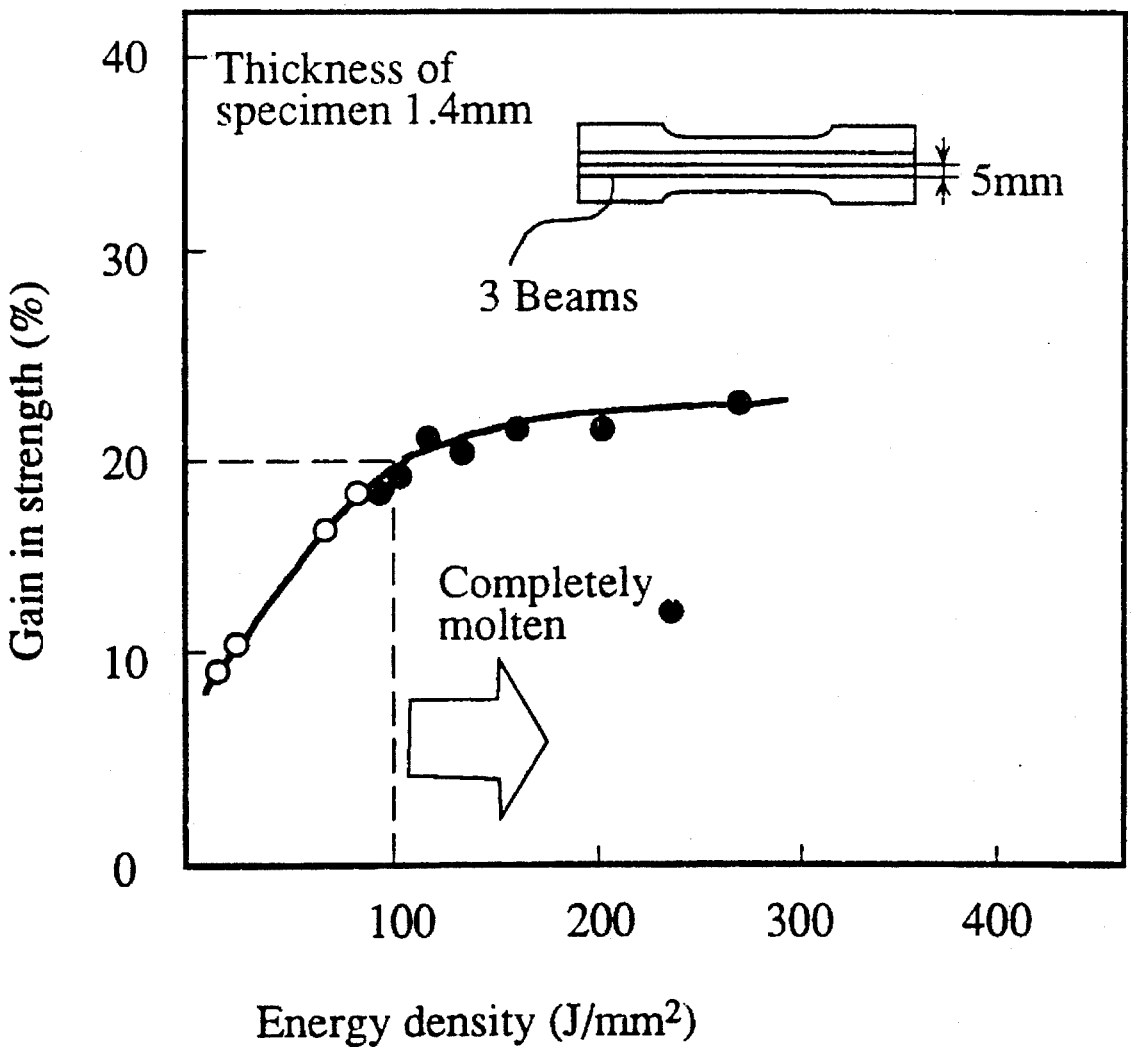
FIG. 1 shows the relation between laser parameters and % gain in strength (low-carbon steel).
Figure 2:
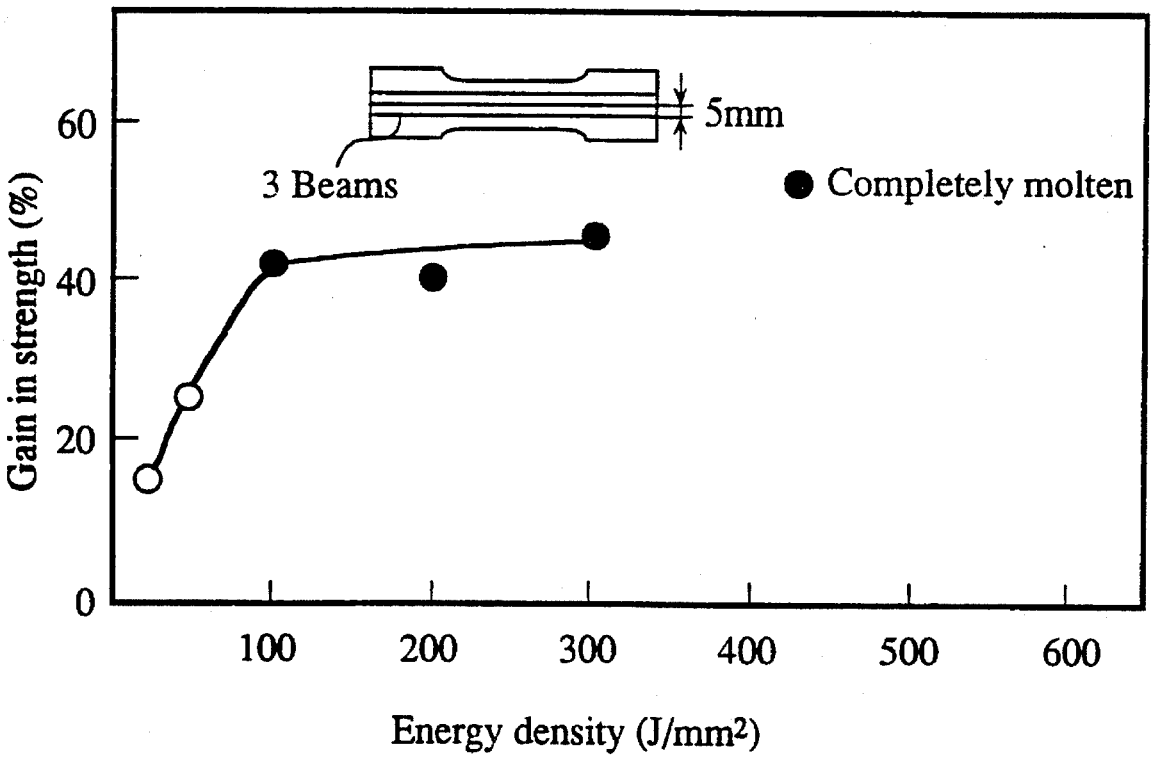
FIG. 2 shows the relation between laser parameters and % gain in strength (ultra-low-carbon steel).
Figure 3:
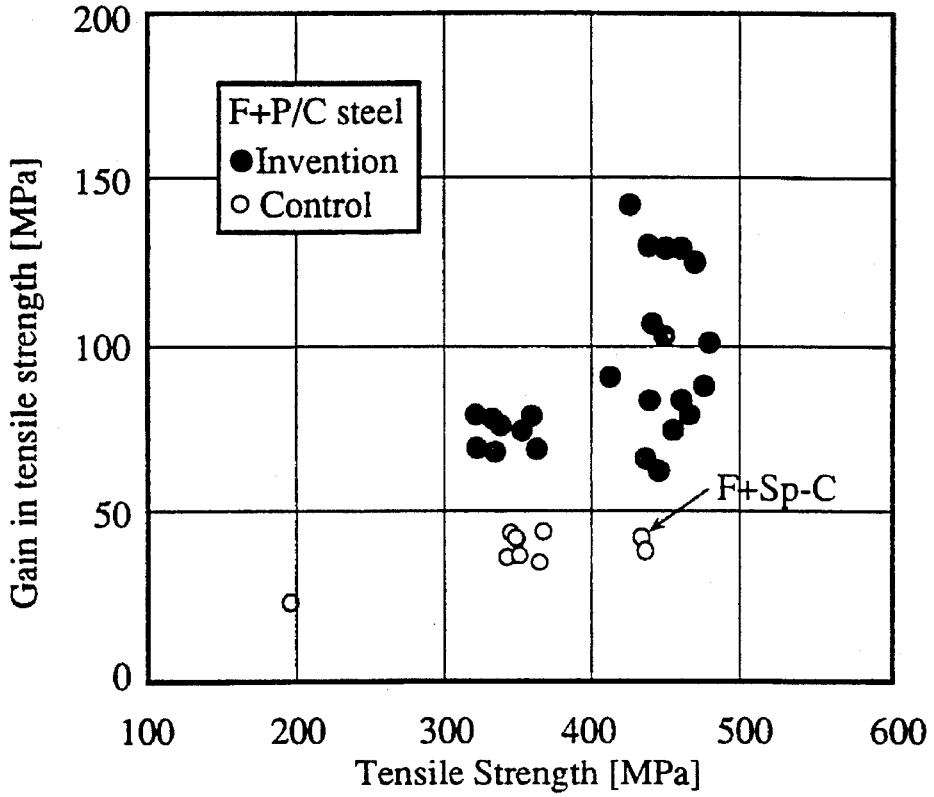
FIG. 3 shows the characteristics of (ferrite+perlite) and (ferrite+cementite) [sometimes referred to briefly as (F+P/C)] steels (inclusive of spheroidized steel) after laser treatment.

Therefore, the relationship between strength (tensile strength) and laser-associated gain in strength was investigated in an (F+P/C) steel and a ferrite+coarse spheroidized cementite [hereinafter referred to sometimes as (F+Sp–C)] steel. The results are shown in FIG. 3. It is apparent from FIG. 3 that compared with the control (F+Sp–C) steel represented by open circles, the (F+P/C) steel of the invention, represented by closed circles, is greater in the gain of strength at the same strength level. Thus, in the balance between formability (which is influenced by material steel strength) and subsequent gain in strength, the (F+P/C) steel of the invention was superior to the control. An exploration into the possible causes for this difference revealed that in order to strike a good balance between formability and gain in strength, the particle size of carbide and the amounts of alloying elements should be controlled within certain limits (See Example 2 which appears hereinafter).

Figure 4:
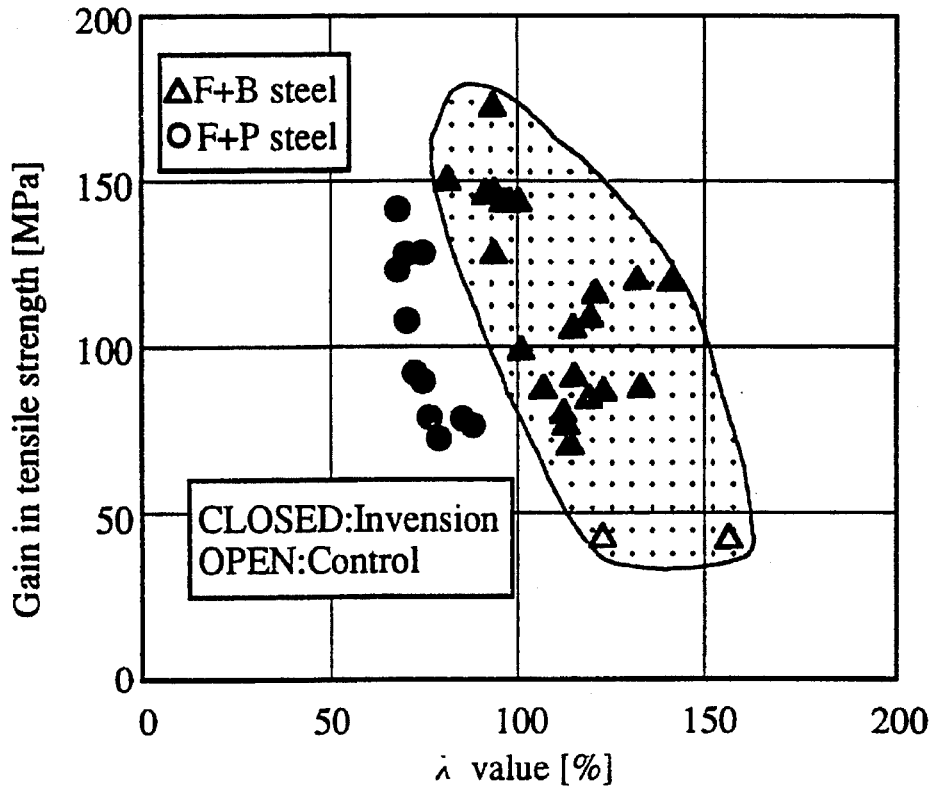
FIG. 4 shows the relative characteristics of (F+P) steel and (F+B) steel after laser treatment.

FIG. 4 shows the relationship between formability and laser-associated gain in strength in each of (F+P) steel and (F+B) steel. As an indicator of formability, the hole expansion rate ($\lambda$) was used. It is clear from FIG. 4 that a very good balance is obtained between formability and gain in strength in the (F+B) steel but no sufficient enhancement of strength was obtained in some cases. An exploration into the cause revealed that in order to strike a good balance between formability and enhancement of strength, it is essential that not only carbide grain size but also the proportions of alloying elements should be controlled within certain limits (See Example 1 which appears hereinafter).

Figure 5:
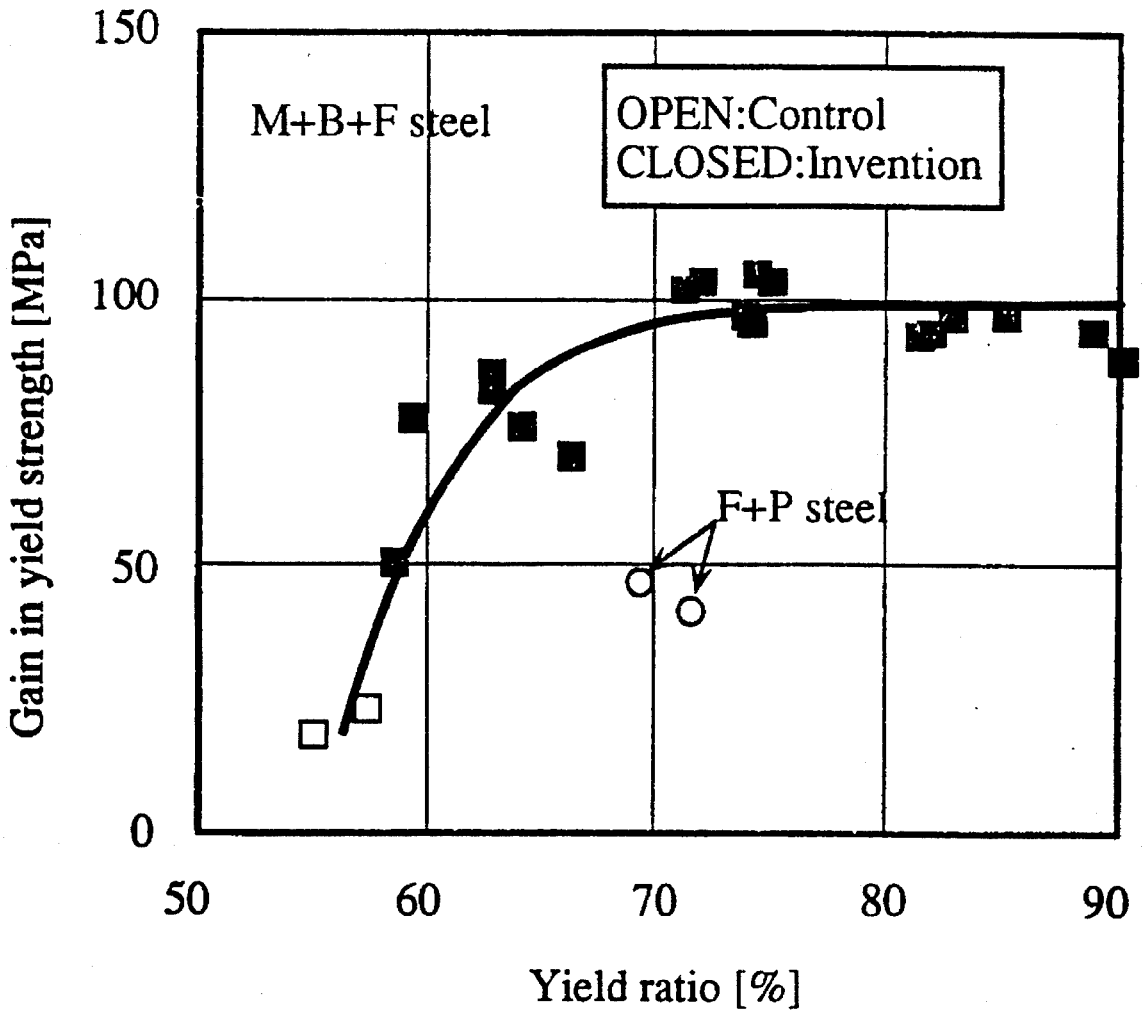
FIG. 5 shows the relation between yield ratio and gain in yield strength.

FIG. 5 shows the relationships between formability and strength enhancement in (F+P) steel and (M+B+F) steel. As an indicator of formability, the ratio of yield point to strength (yield ratio) was used. As an indicator of strength, yield strength was used. In press forming, the lower the yield strength, the lower is the forming load. Therefore, steel materials with low yield ratios are sometimes demanded. However, in pressed products, a high yield strength is required in order to protect against deformation due to external forces. When FIG. 5 is scrutinized from this point of view, the (M+B+F) steel is superior to the (F+P) steel in the balance between formability and gain in strength. In the (M+B+F) steel, too, there are cases in which no sufficient gain in strength can be realized. An exploration into the cause revealed that in (M+B+F) steel, too, not only carbide size but also proportions of alloying elements are important factors in the enhancement of strength.

Figure 6:
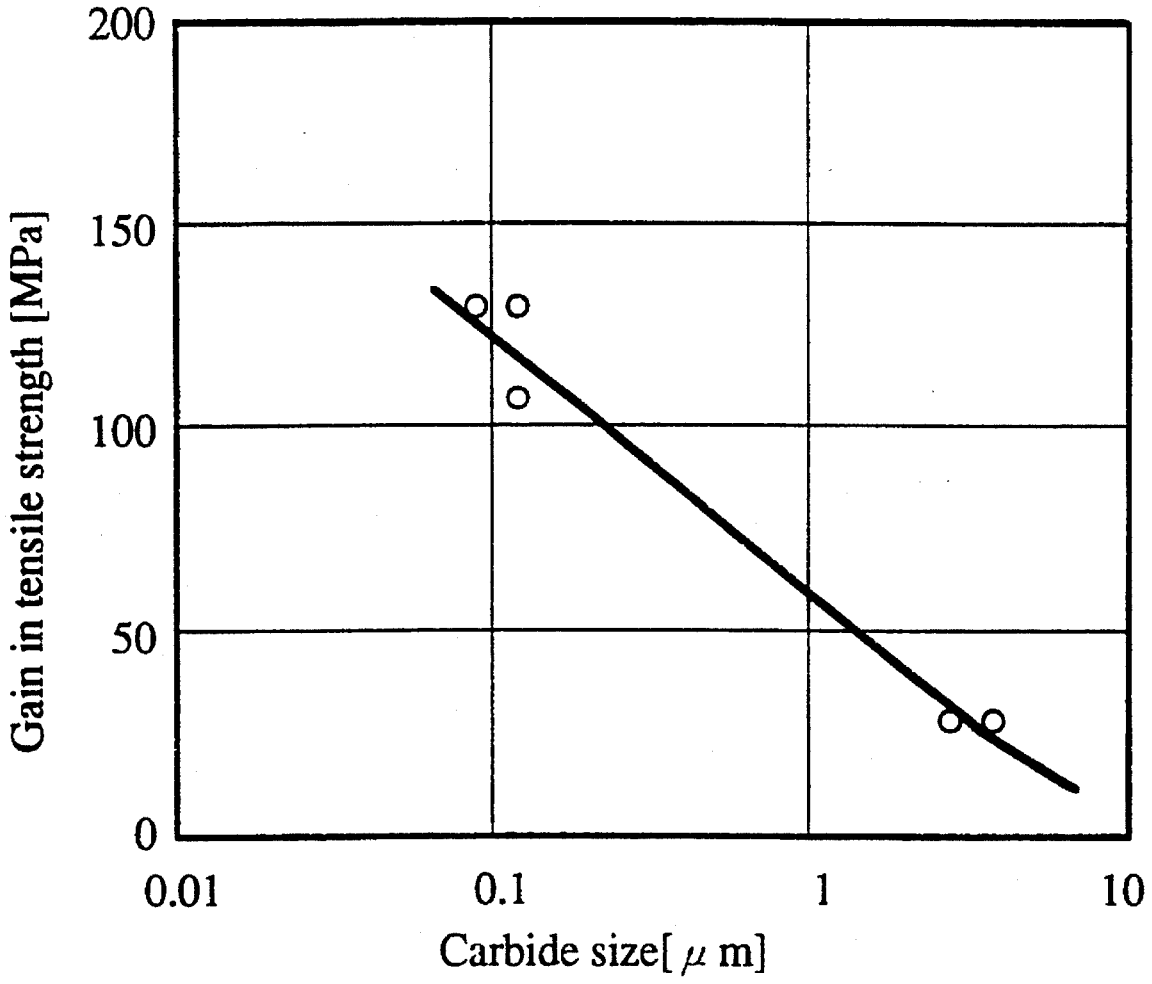
FIG. 6 shows the relation between carbide size and % gain in strength due to laser treatment.

Then, the influence of carbide size was investigated. First, the relationship between the length of the shorter side of carbide grains and the amount of gain in strength was analyzed. The results are shown in FIG. 6. The carbide size was determined by imaging the cross-section of a testpiece by SEM and measuring the dimension of the shorter side of the carbide grain (where the grain section was circular, the diameter) on the photograph. It is apparent from FIG. 6 that the enhancement of strength begins to diminish as the dimension of the shorter side of carbide grain exceeds 1 μm. In other words, it was found that a good balance between useful formability and useful gain in strain can be achieved only by reducing carbide size through the formation of bainite or perlite microstructures and controlling the proportions of alloying elements within definite limits.

Figure 21:
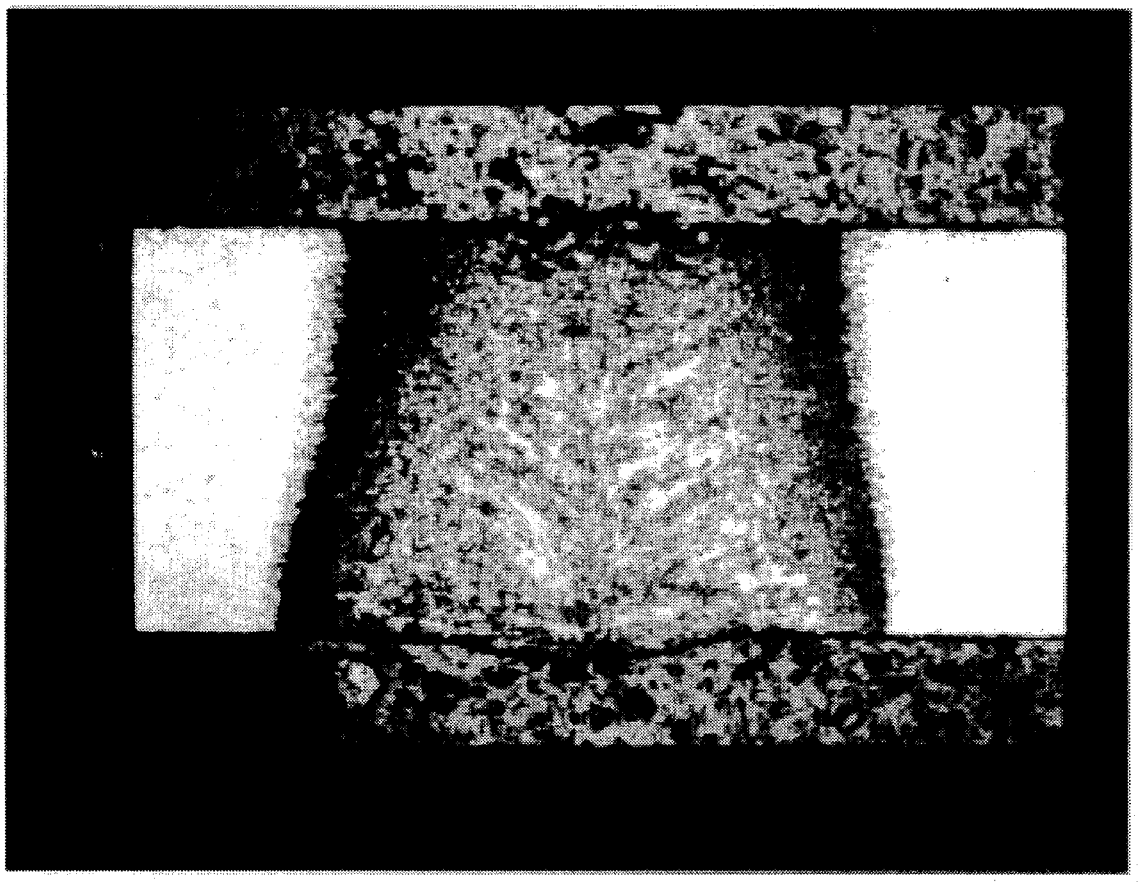
FIG. 21 shows photograph showing the microstructure in the laser-treated zone.
Figure 22A:
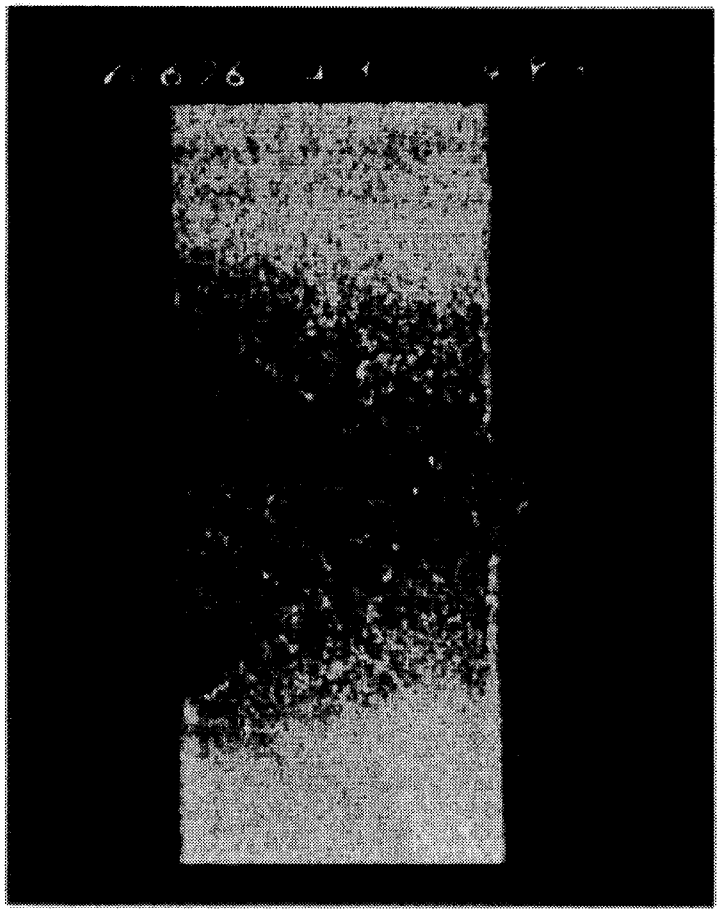
FIGS. 22(*a*) and 22(*b*) show photographs each showing the cross-section of steel in the laser-treated zone.
Figure 22B:
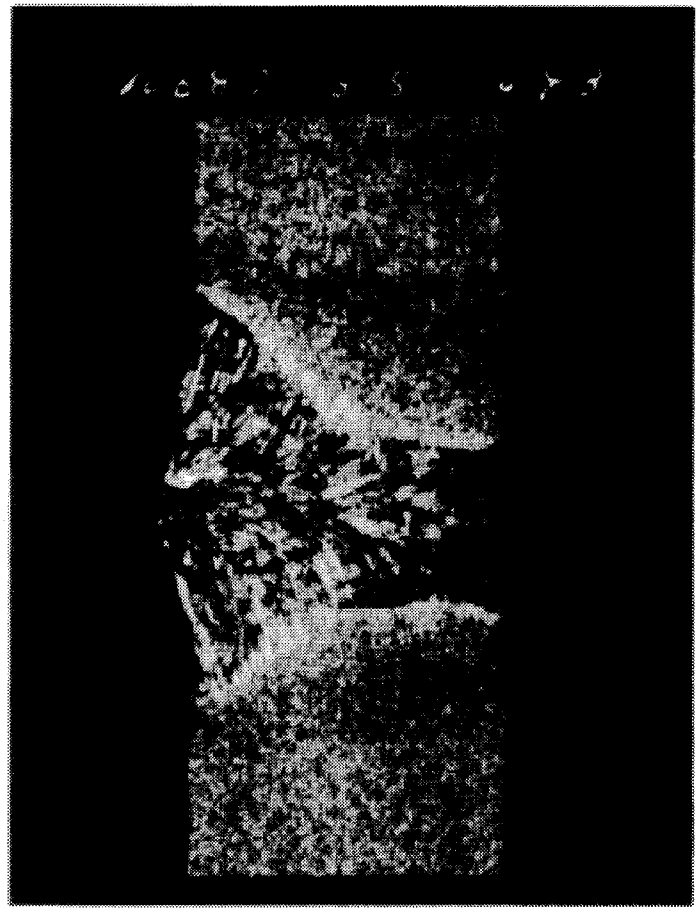

As the factor responsible for the above result, it may be pointed out that the hardened phase due to laser treatment is relatively large in area when the above-mentioned condition is satisfied. Thus, examination of the sectional microstructure after laser treatment in testpieces with a solidification phase penetrating through the thickness revealed that the area of the hardened phase was large in the steels having an (F+B) microstructure and satisfying the above condition [See FIG. 21 referred to in Example 1], suggesting that the large gains in strength were attributable to these increased areas. Although not as good as the above cases of (F+B), the steel showing an (F+P) microstructure and satisfying the above condition [See FIG. 22 (*a*) referred to in Example 2] had a large hardened phase area. However, even among (F+P) steels, the testpiece having coarse spheroidized microstructures [FIG. 22 (*b*) referred to in Example 2], which did not satisfy the above condition, had only a small hardened area. It is, therefore, though that steels with carbide grains not greater than 1 μm in shorter side dimension and containing alloying elements in definite ranges showed a distinct pattern of dissolution of carbide grains with a consequent increase in hardened area.

Thus, in the martensite phase of a (M+B+F) steel, the carbide grains precipitating out in the course of laser treatment are so small in size that they are readily dissolved. In the bainite phase, too, similarly minute carbides may dissolve in the course of laser heating. The result is that the hardened area becomes sufficiently large.

Figure 7:
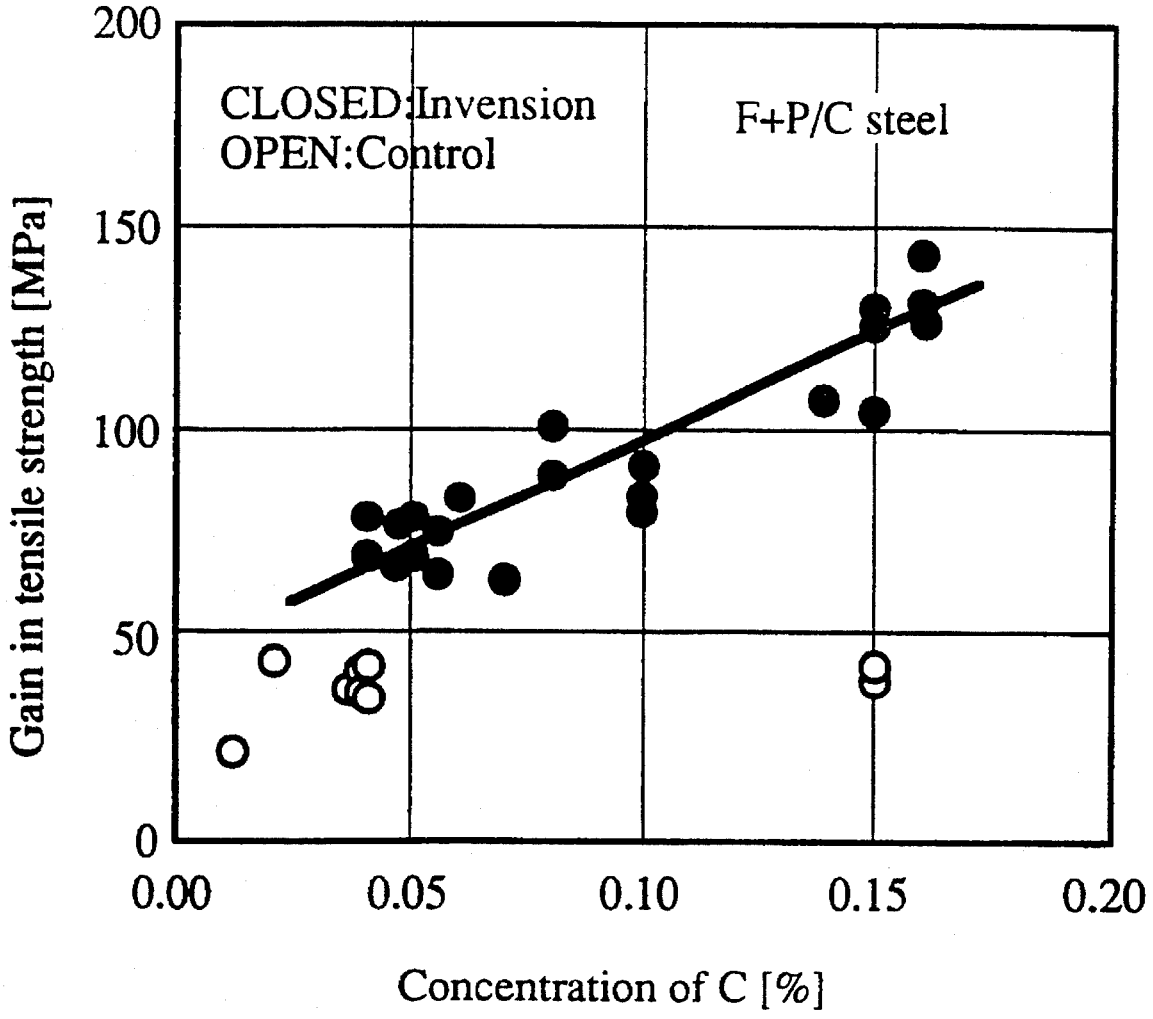
FIG. 7 shows the relation between carbon content and gain in strength due to laser treatment.

FIG. 7 shows the relationship between carbon content and laser-associated gain in strength in (F+P/C) steel. It is apparent that there is a variation in the amount of gain in strength even at the same carbon level.

This means that in addition to differences in carbon content, effects of other elements must also be taken into consideration.

Therefore, the effect of the proportions of alloying elements on the enhancement of strength was investigated.

First, using the data on low-carbon (F-B) steel, the relationship between the $K_1$ value given by the following equation and the degree of strength enhancement was analyzed.

$$K_1=(Mn\%+0.25.Si\%)\times C[\{]ps$$

Figure 8:
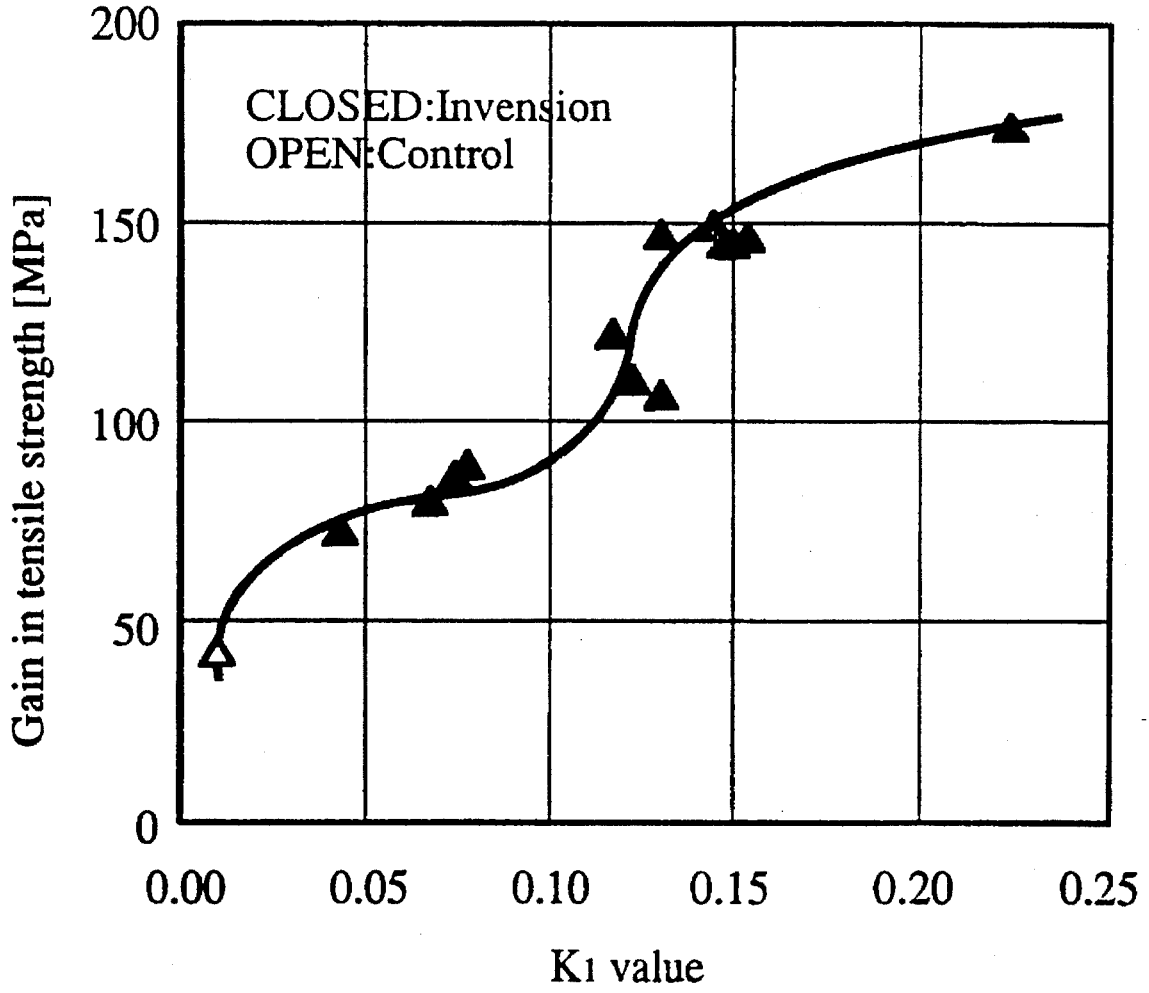
FIG. 8 shows the relation between $K_1$ value and gain in tensile strength.

The results are shown in FIG. 8. The practically acceptable degree of laser-associated gain in strength should not be less than 50 MPa. The cases in which the amount of gain in strength was less than 50 MPa were specimens with carbon contents less than 0.02% and those with Mn contents less than 0.3%. It can be seen from FIG. 8 that large gains in strength are realized when the $K_1$ value exceeds 0.1. Therefore, the value of $K_1$ is preferably set at not less than 0.1.

Figure 9A:
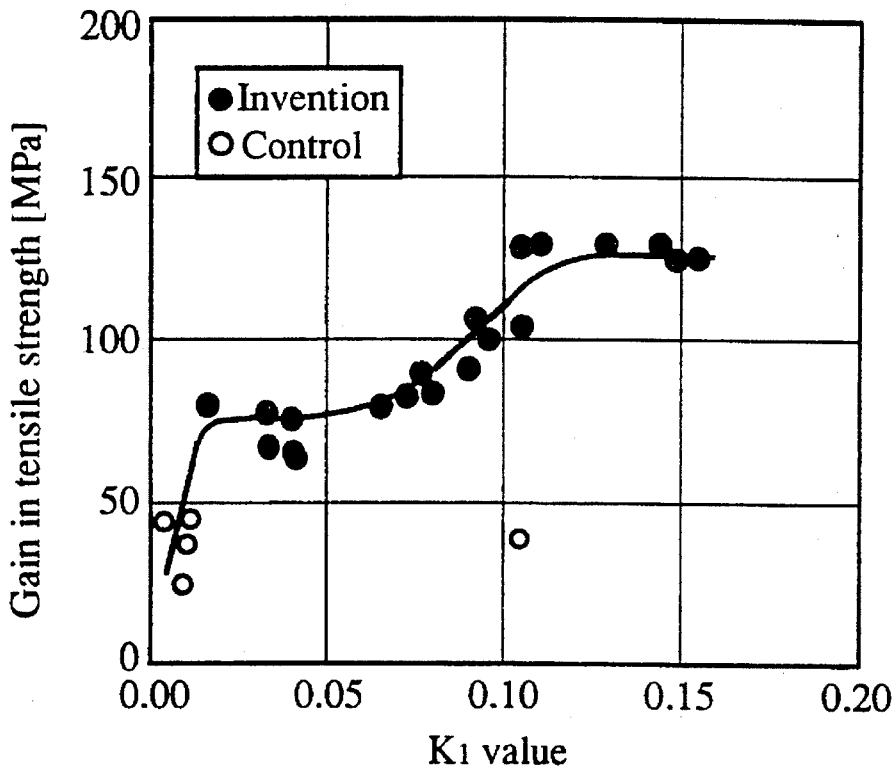
FIGS. 9(*a*) and 9(*b*) show the relation between $K_1$ value and gain in tensile strength.
Figure 9B:
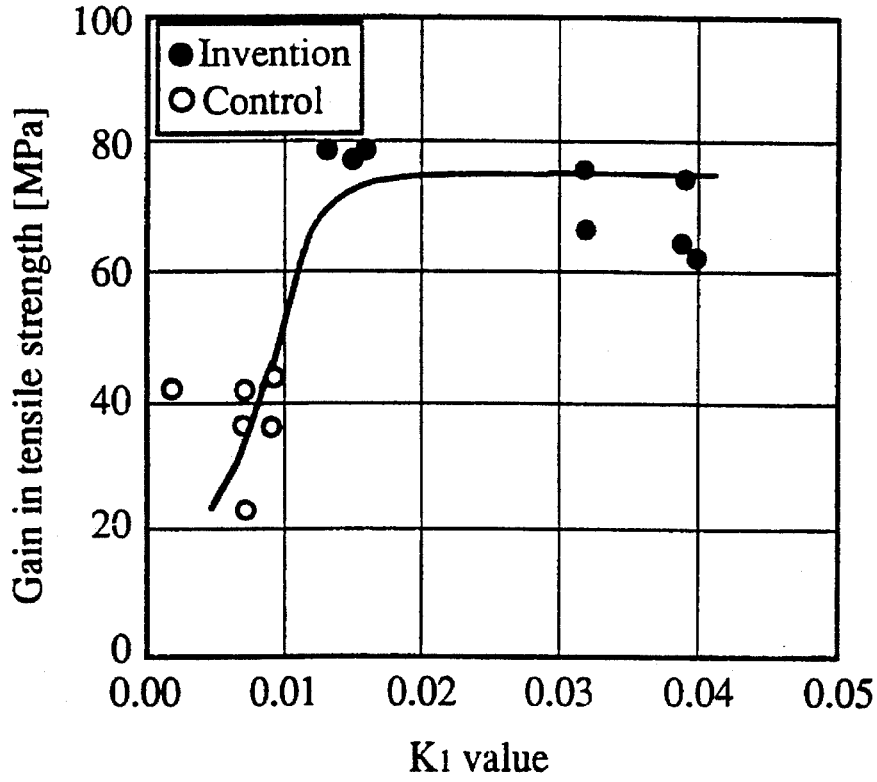

Then, using data on the low-carbon (F+P/C) steel, the relationship between $K_1$ and gain in strength was similarly analyzed. The results are shown in FIG. 9. In FIG. 9, (*b*) is an enlarged view of the left bottom part (low-$K_1$ region) of (*a*). It is apparent from FIG. 9 that large gains in strength were realized when $K_1$ values were not less than 0.01. While some steels showed together which are subjected to spheroidizing treatment show small gain in strength, though $K_1$ is around 0.1. The steels in which the amount of laser-associated gain in strength was less than 50 MPa were specimens with C contents less than 0.02% and those with Mn contents less than 0.3%. All told, as can be seen from the diagrams referred to above, in the low-carbon (F+P/C) steel in contrast to the low-carbon (F+B) steel, a lower $K_1$ value contributes to strength increase. Therefore, the $K_1$ value is set at not less than 0.01 and preferably not less than 0.05.

Figure 10:
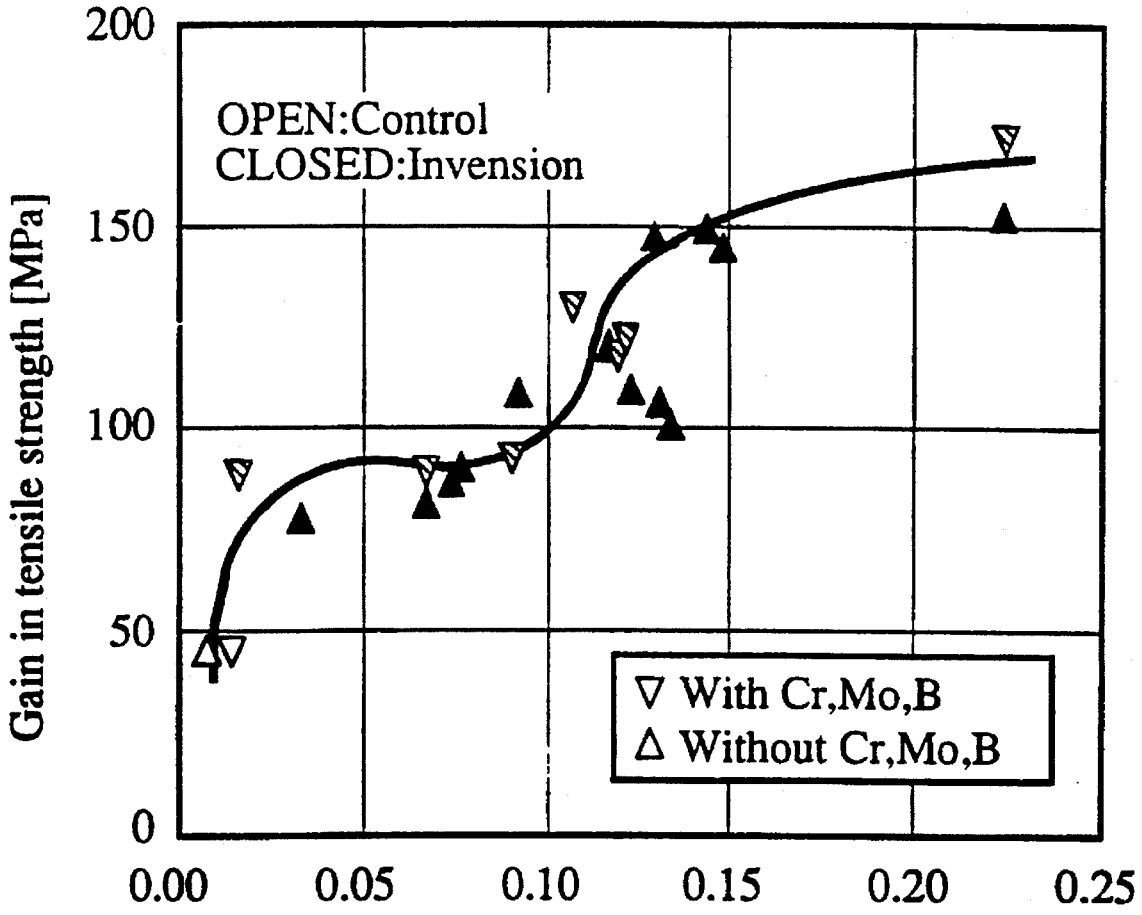
FIG. 10 shows the relation between $K_2$ value and gain in tensile strength.

While the essential alloying elements in the low-carbon steel of the present invention are C, Si and Mn, the three elements of Cr, Mo and B can be selectively added as equivalent elements to the above fundamental composition as will be explained hereinafter. Accordingly, the effect of each of these additive elements, if used, was investigated. A typical example can be shown as in FIG. 10. Thus, FIG. 10 shows the effects of the respective additive elements on a (F+B) low-carbon steel plate in terms of the relationship between $K^2$, which is given by the following equation, and gain in strength.

$$K_2=(Mn\%+Cr\%+Mo\%+250.B\%+0.25.Si\%)\times C\%$$

This $K_2$ value takes into account the effects of Cr, Mo and B added. It is apparent from FIG. 10 that a marked gain in strength can be realized when the $K_2$ value is not less than 0.1.

Figure 11:
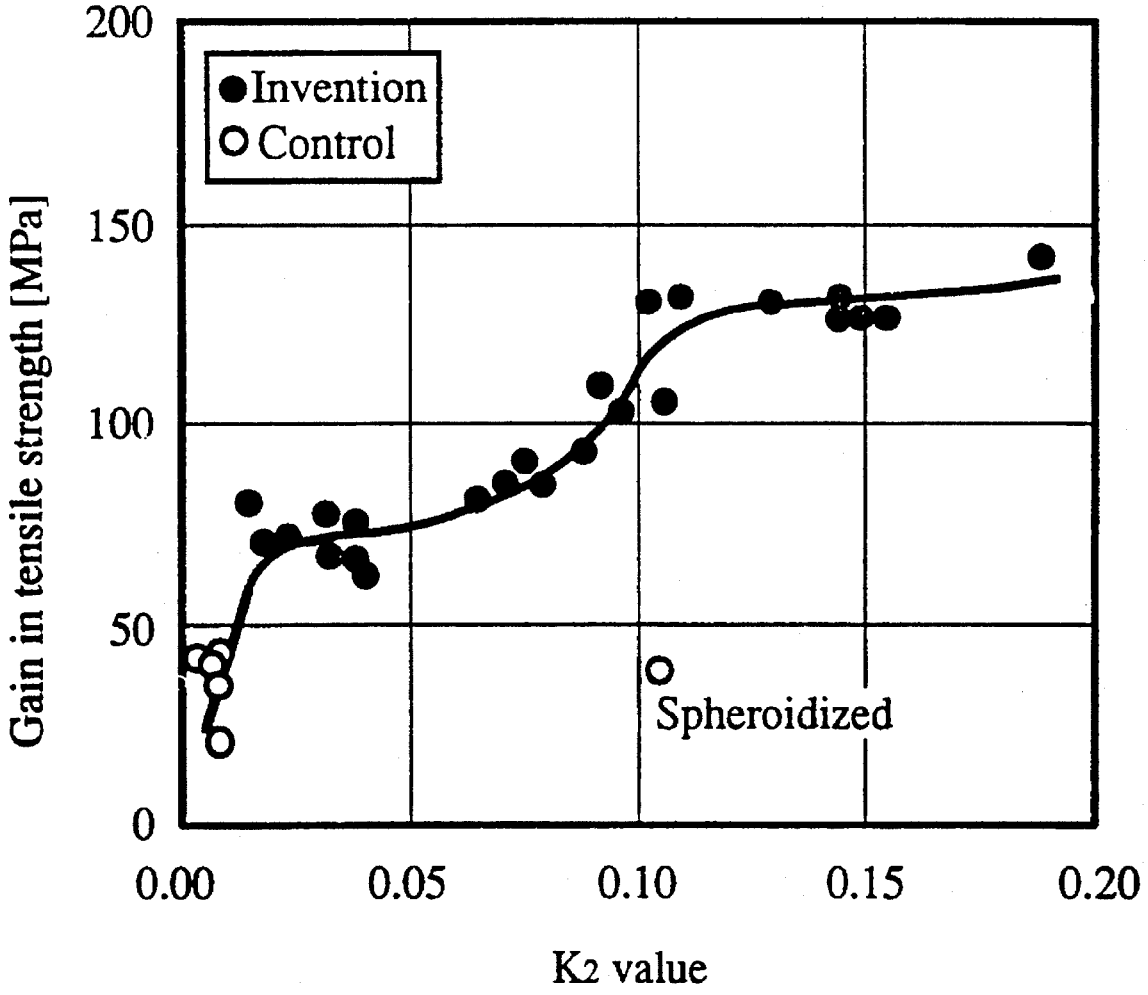
FIG. 11 shows the relation between $K_2$ value and gain in tensile strength.

Then, the relationship between $K_2$ and gain in strength was investigated in (F+P/C) steel, too. The results are shown in FIG. 11, which takes into account the effects of Cr, Mo and B as in the above case. It is apparent that when the $K_2$ value is not less than 0.05 and preferably not less than 0.1, the $K_2$ value also contributes a great deal to increased strength.

Figure 12:
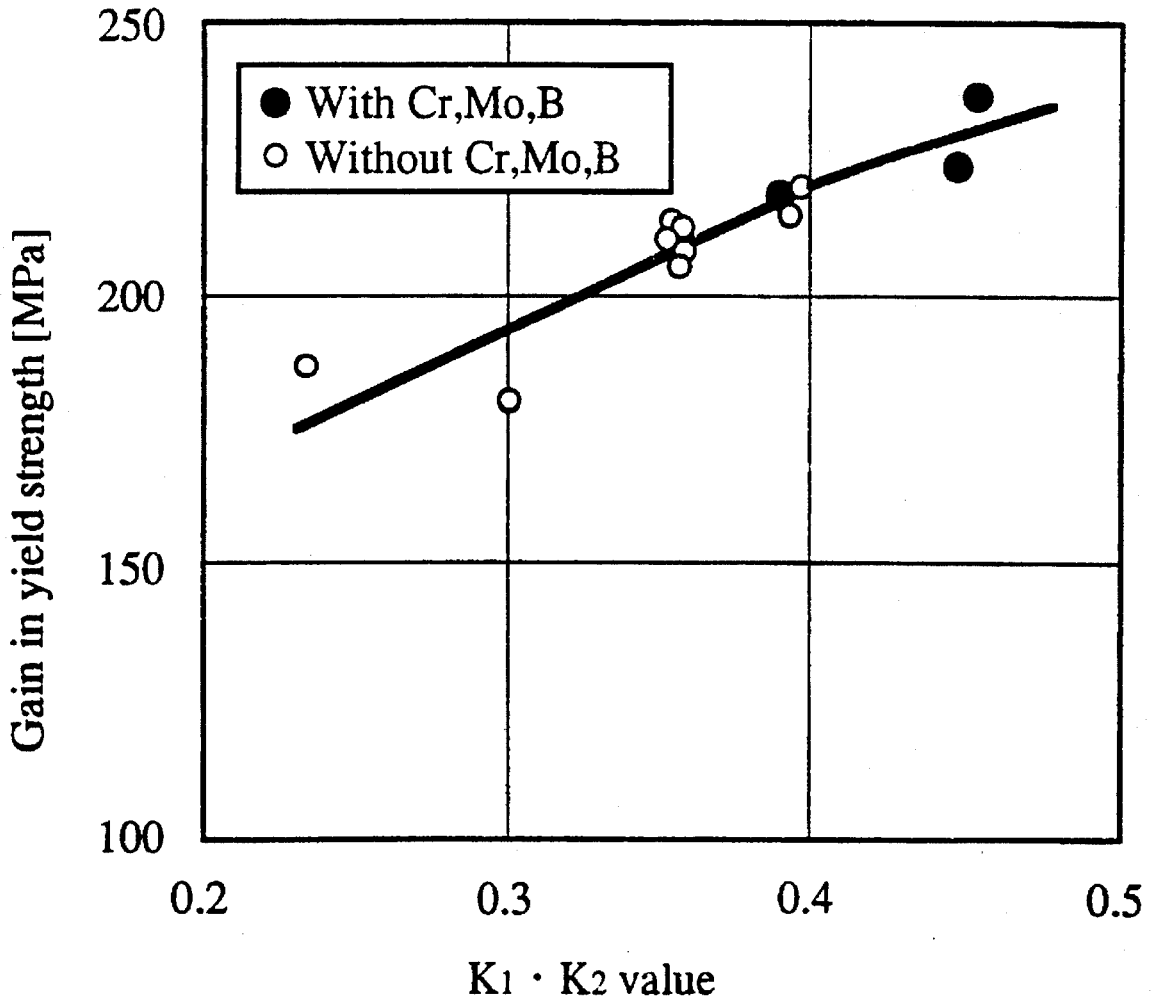
FIG. 12 shows the relationship of $K_1$ and $K_2$ values with gain in yield strength.

The present invention covers the target microstructure of (F+γ+M/B) as well. In this case, as shown in FIG. 12, a large gain in yield strength, amounting to 200 MPa, was obtained when whichever of $K_1$ and $K_2$ was not less than 0.35.

Figure 13A:
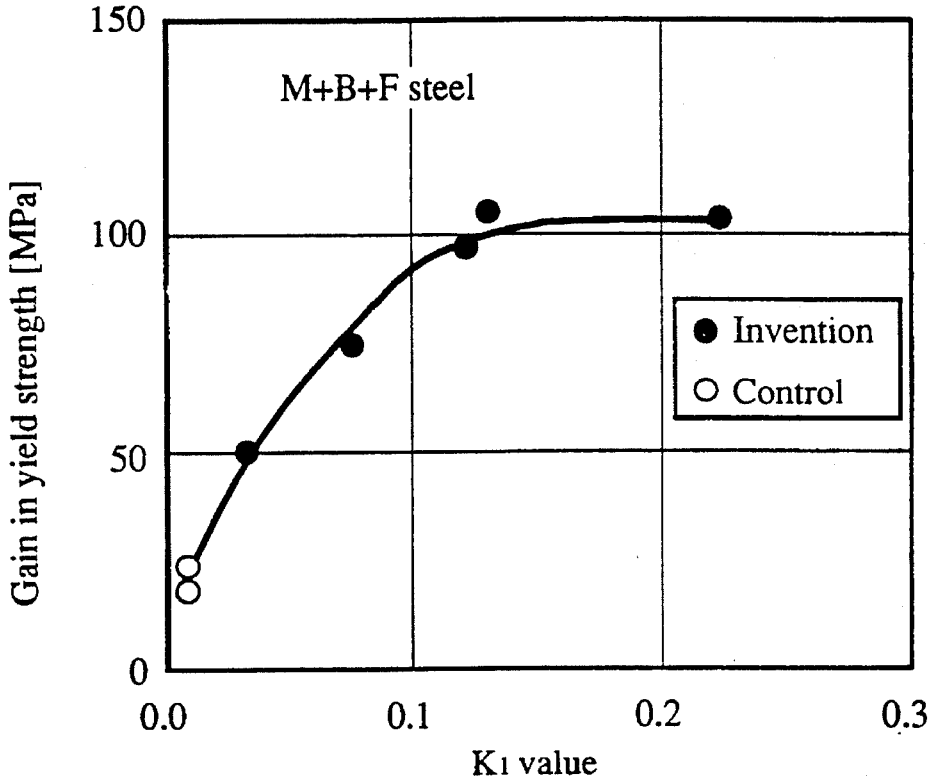
FIGS. 13(*a*) and 13(*b*) show the relation between $K_1$ value and gain in yield strength.
Figure 13B:
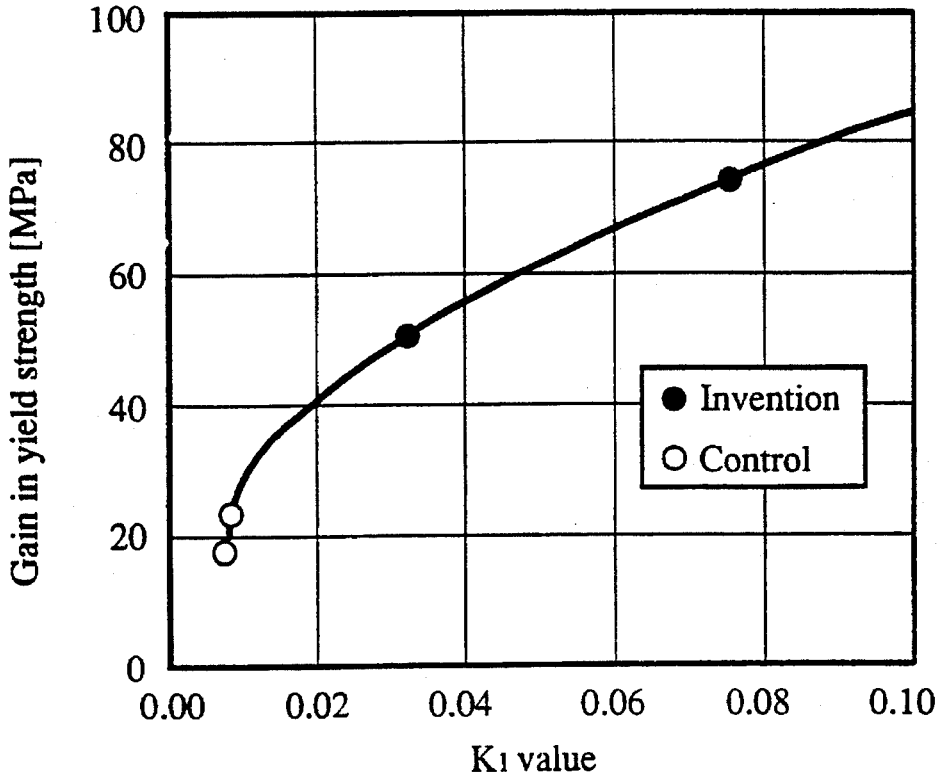
Figure 14:
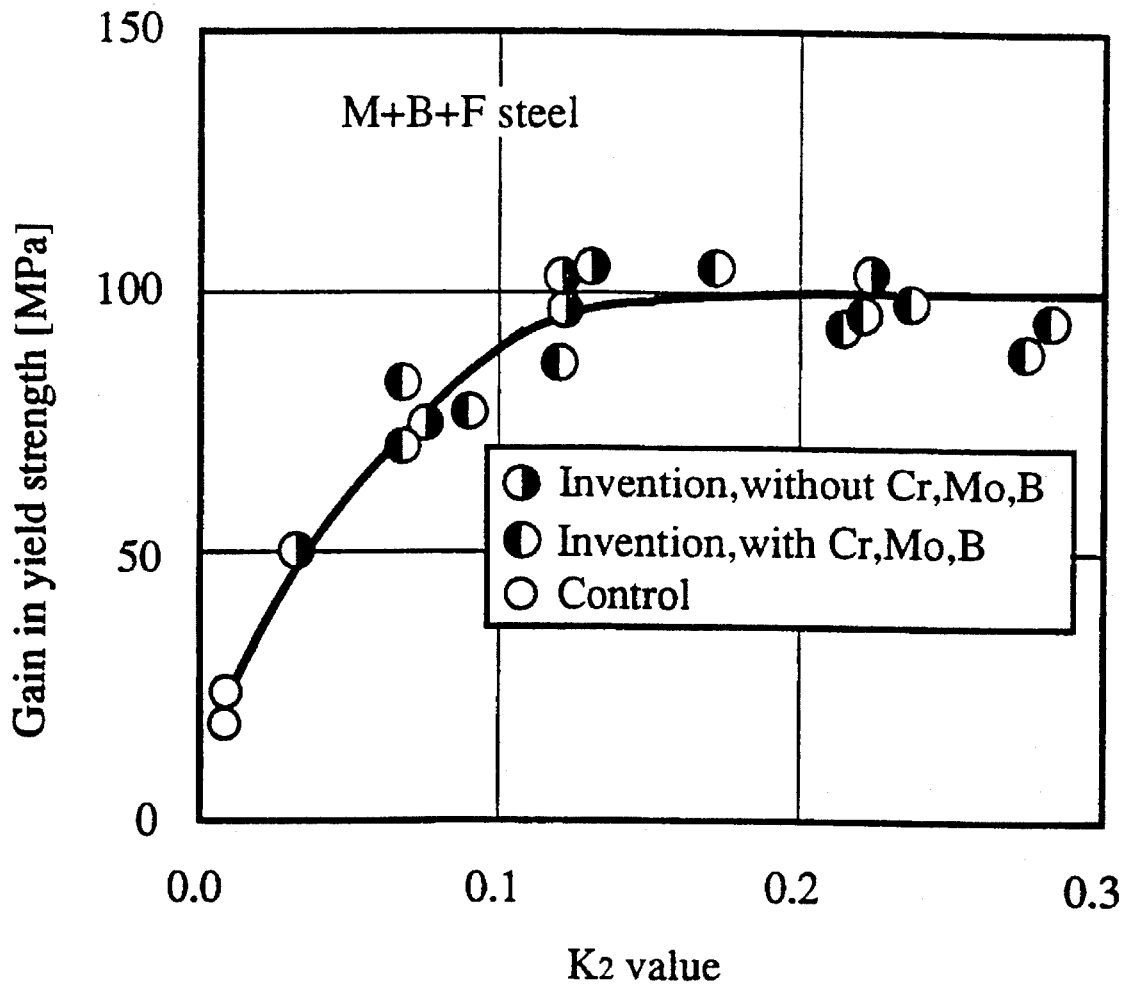
FIG. 14 shows the relation between $K_2$ value and gain in yield strength.

FIG. 13 (*a*) and (*b*) and FIG. 14 show the relationships of $K_1$ (FIG. 13) and $K_2$ (FIG. 14), both calculated by the respective equations given above, with the amount of gain in yield strength in (M+B+F) steel. FIG. 13 (*b*) is an enlarged view of the left bottom part (a region with a low $K_1$ value) of FIG. 13 (*a*). In consideration of the strength level required of the steel of the invention, the amount of laser-associated gain in strength should be at least about 50 MPa. Only the steel specimen with a C content of 0.01% and an Mn content of 0.7% and the specimen with a C content of 0.04% and an Mn content of 0.21% failed to provide a strength gain of 50

MPa, indicating that the C and Mn contents should be controlled at not less than 0.02% and not less than 0.3%, respectively. It is also clear that whichever of $K_1$ and $K_2$ is preferably not less than 0.1. It was further found that the effects of addition of Cr, Mo and B could be represented by the concept of $K_2$.

On the other hand, it was found that in the ultra-low-carbon steel in which a ferrite structure predominates, P and B among said additive elements have important bearings on increased strength. Thus, in the case of ferrite-rich ultra-low-carbon steel, the value of T given by the following equation in lieu of said $K_2$ value assumes a significant meaning.

$$T=(Mn\%+20.P\%+250.B\%+0.25.Si\%)\times C\%$$

Figure 15A:
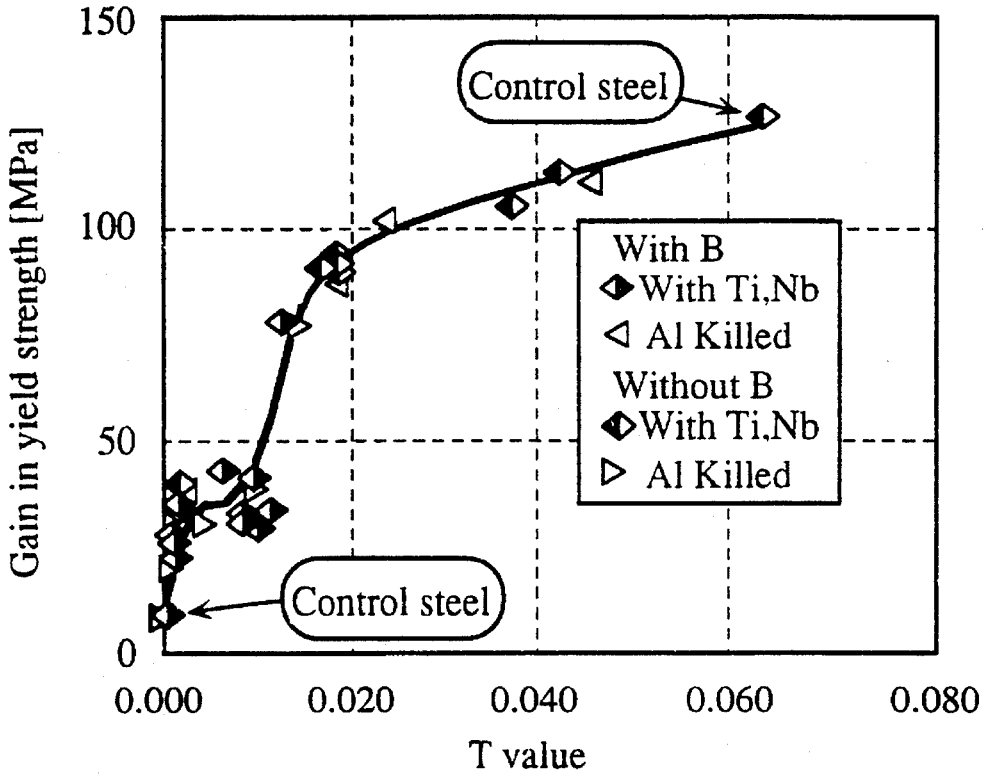
FIGS. 15(*a*) and 15(*b*) show the relation between T value and gain in yield strength.
Figure 15B:
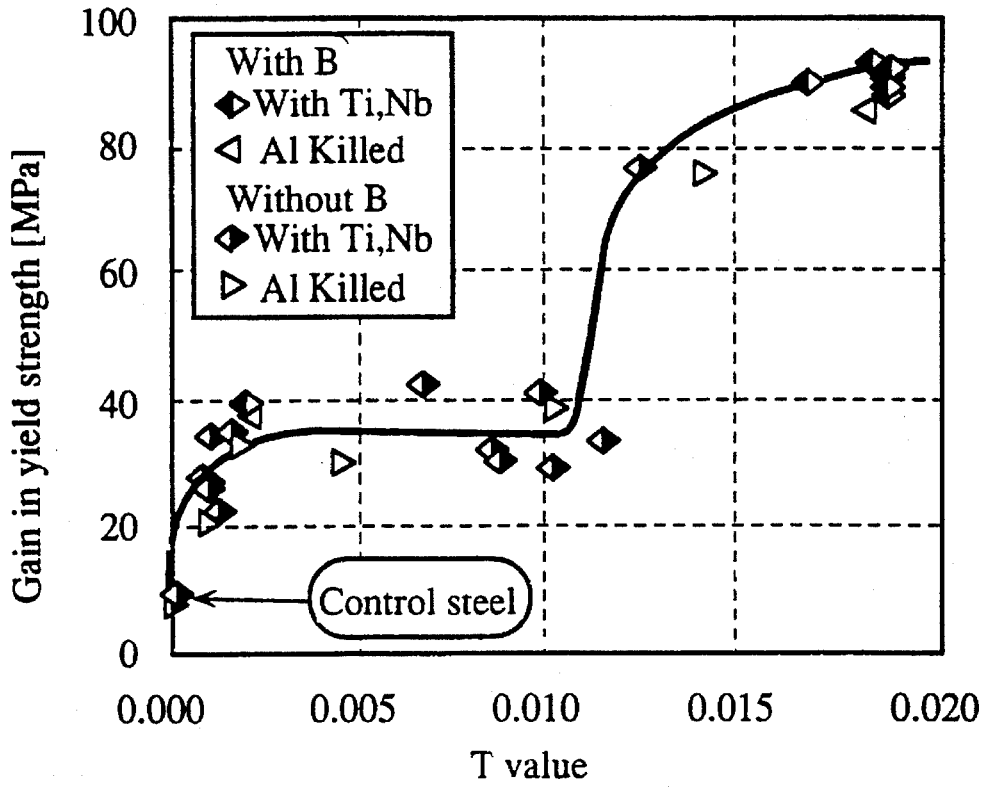

FIG. 15 (*a*) and (*b*) represent the relationship between T and gain in yield strength, and (*b*) is an enlarged view of the left bottom part (the region with a lower T value) of (*a*).

Figure 16:
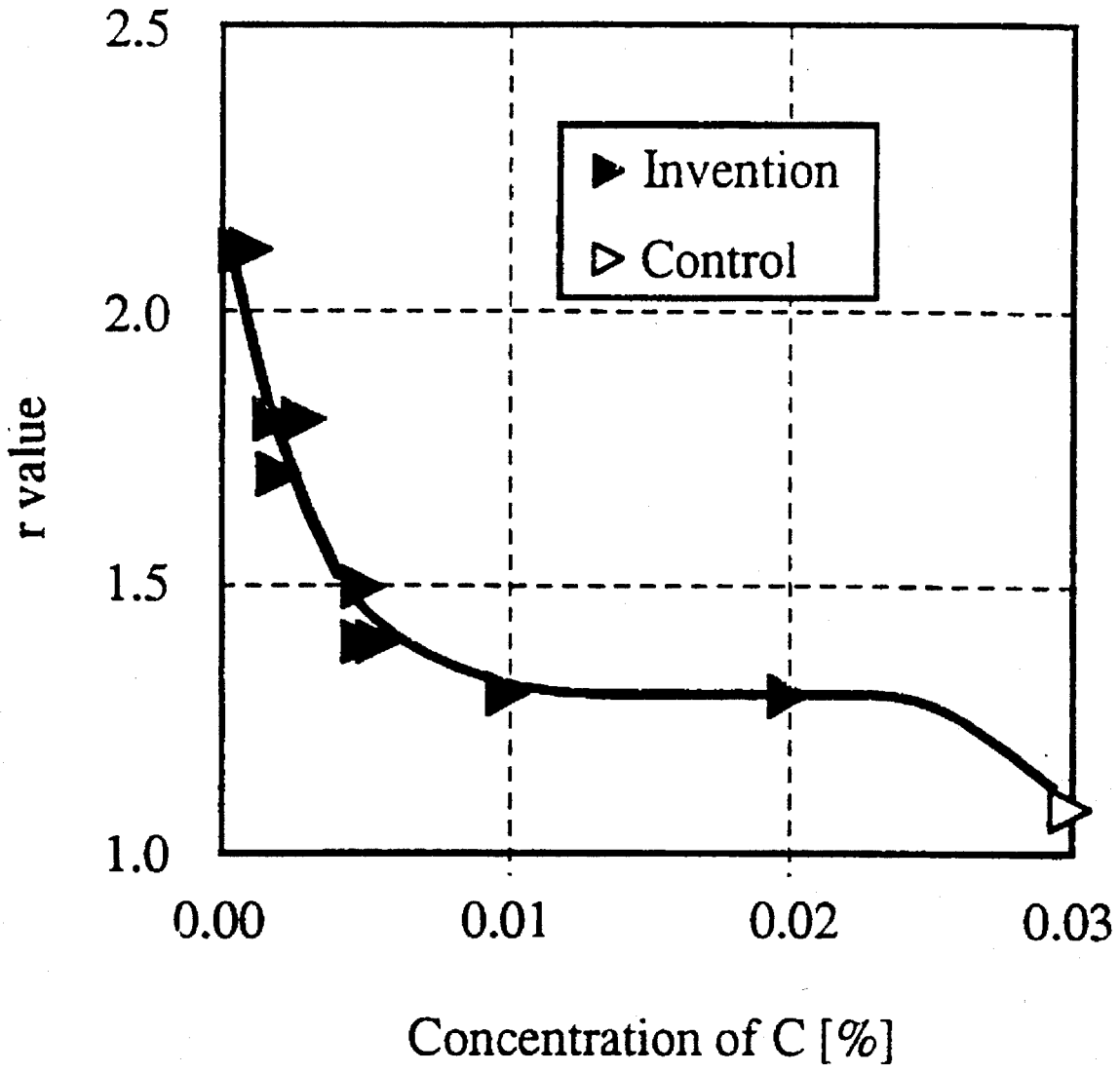
FIG. 16 shows the relation between C concentration and r value of Nb and Ti added steel.

Referring to (*b*) in the first place, the gain in yield strength was only about 8 to 10 MPa in the case of C<0.002% and MN<0.1%. It is seen from (*b*) that the value of T is preferably controlled at not less than 0.01. Referring to (*a*), there were cases in which marked gains in strength were realized in the neighborhood of T=0.06 but the value of r (an indicator of deep drawability) had been reduced to 1.1 in this neighborhood (the formability of ultra-low-carbon steel is generally expressed in γ). The reason appears to be the high carbon content of 0.03%. FIG. 16 shows the relationship between C and r, indicating that the value of r declines remarkably when C exceeds 0.02%.

Now, using some of the data given in the Examples, the significance of satisfying the condition of alloying formulation is explained.

Figure 17:
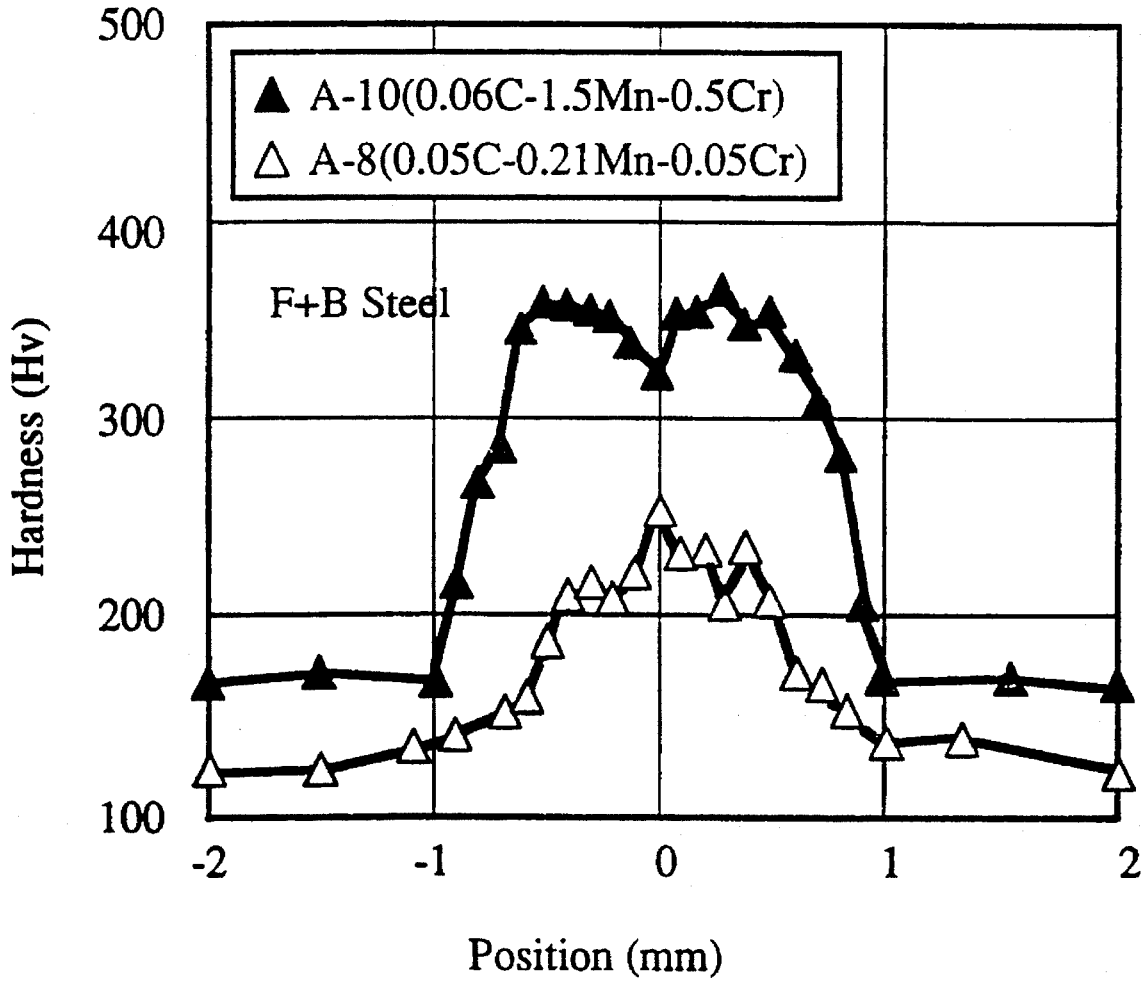
FIG. 17 shows the hardness (Hv) profile of laser-treated steel plate.

In the first place, FIG. 17 shows the hardness profile of the laser-treated region of the low-carbon (F+B) steel of the invention where the above-mentioned condition of alloy formulation is satisfied [the steel of the invention (A-10) in Example 1] as compared with the low-carbon (F+B) steel which does not satisfy the same condition of alloy formulation [Control steel (A-8) in Example 1]. In the case of FIG. 17, the Mn content of control steel (A-8) is insufficient so that despite the finished steel structure of (F+B), the inadequate hardenability fails to provide an adequate hardness.

Figure 18:
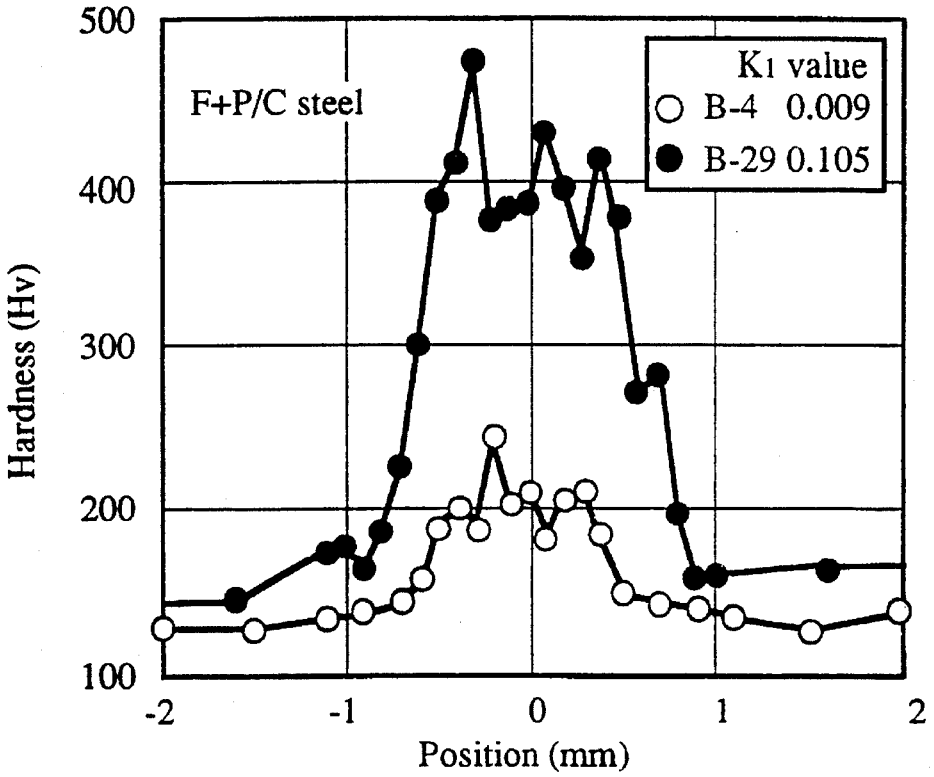
FIG. 18 shows the hardness (Hv) profile of laser-treated steel plate.
Figure 19:
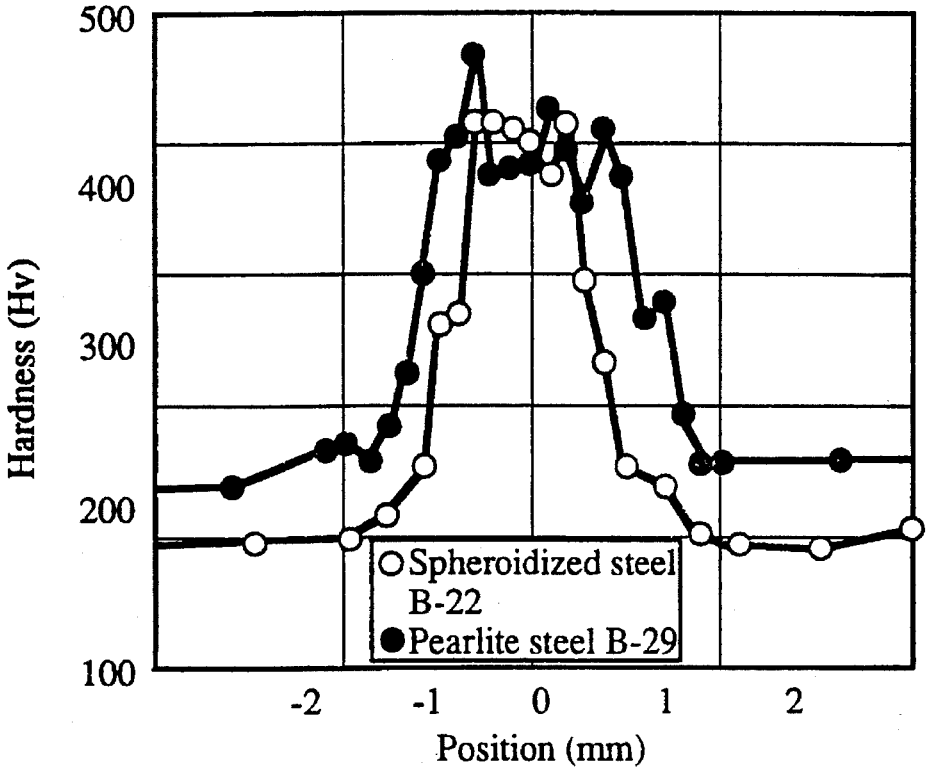
FIG. 19 shows the hardness (Hv) profile of laser-treated steel plate.

The hardness profile of the laser-treated region of (F+P/C) steel was similarly investigated. FIG. 18 shows the hardness profile of the laser-treated region of the steel of the invention in which the condition of alloy formulation is satisfied as contrasted to the control steel in which the above condition is not satisfied. The control steel (B-4) in FIG. 18 has a $K_1$ value of not greater than 0.01, with the result that despite its having been finished as a (F+P/C) steel, the inadequate hardenability fails to provide a sufficient degree of hardness. In the case of control steel (B-22) in FIG. 19, a sufficiently high maximum hardness was obtained because the condition of alloy formulation was satisfied but the hardened region was narrow in breadth because of the (F+Sp–C) structure. This result cannot be explained in terms of hardenability alone but it is suspected that this difference was occasioned by differences in the transformation temperature of the alloy composition and the pattern of carbide dissolution associated with carbide grain size.

Now, the significance of the quantitative limitations on the respective alloying elements for the steel plate of the invention is now explained.

The steel plate of the invention must be suited for cold working such as press forming and in this sense the level of added carbon is preferably as low as possible. On the other hand, an increase of strength by laser treatment is an important requirement and in order to satisfy this requirement, it is necessary to have a certain amount of carbon available in the steel. For example, in order to provide a steel with the usual low carbon level and an (F+B) microstructure, at least 0.02% of carbon must be incorporated. When the level of addition of C is about 0.01%, for instance, no sufficient gain in strength can be obtained by laser treatment as will be described hereinafter. On the other hand, the addition of carbon in excess detracts considerably from the formability and weldability of steel. Therefore, the upper limit of C is set at 0.30%. when the target structure is (F+γ+M/B), it is advisable to narrow the preferred range for C, if only for an improved reproducibility of the above microstructure. Therefore, the range of 0.05 to 0.25% is recommended in the present invention.

The present invention encompasses, within its technical scope, ultra-low-carbon steels in which a ferritic phase predominates. In such cases, the carbon content should be lower than the above-mentioned lower limit. In the present invention, the range of 0.002 to 0.02% was adopted. When the C content is less than 0.002%, the gain in strength that can be realized by laser or other equivalent high-density energy treatment cannot be greater than 20 MPa in terms of yield strength. Therefore, the lower limit of 0.002% is essential. On the other hand, if the C content exceeds 0.02%, the intrinsic formability of the steel material cannot be that of an ultra-low-carbon steel.

Si is added for enhancing the effect of laser treatment but since the addition of more than 1.5% of Si usually results in a roughened surface, the upper limit for Si is set at 1.5%. However, when the target structure is (F+γ+M/B), 3.0% can be an allowable upper limit.

When a ferrite-rich ultra-low-carbon steel is desired, the upper limit for Si may be 2.0%.

Mn, too, is added according to the required strength of steel but the addition of this element in excess sacrifices cold formability. Therefore, the upper limit for Mn is set at 2.5%. However, when the target structure is (F+γ+M/B), an acceptable cold formability can still be obtained even if the upper limit is escalated to 3.0%. As to the lower limit for Mn, the limit of 0.1% is recommended in the sense that a sufficient strength gain may be realized by laser treatment (a gain of not less than 20 MPa in yield strength). The preferred lower limit is 0.3% and, for a more positive enhancement of strength, Mn is preferably added in a proportion not less than 1.2%. For the purpose of implementing an (F+γ+M/B) structure, the addition of at least 1.1% of Mn is necessary from the standpoint of insuring the particular microstructure.

While the essential alloying elements of the steel according to the present invention are mentioned above, with the balance being Fe and unavoidable impurity, the following elements can further be added as necessary.

Cr is an element which is not only effective for the enhancement of strength by laser treatment but also in suppressing the yield ratio of steel to a low level. However, the addition of Cr in an unnecessarily large proportion is uneconomical. Moreover, if the Cr content exceeds 2.5%, martensite microstructures develop to drastically reduce the hole expansion rate. Therefore, the upper limit for Cr is set at 2.5%.

Mo is effective for the enhancement of strength by laser treatment but the addition of Mo in an unnecessarily large proportion is uneconomical. From this economic consideration, the upper limit for Mo is set at 1.0%.

B is an element which is also effective for the enhancement of strength by laser treatment but the addition of 50 ppm or more of B detracts considerably from the ductility of steel. Therefore, the upper limit for B is set at 50 ppm. Though the lower limit is not critical, the addition of at least 5 ppm is recommended.

The above-mentioned three elements are particularly significant in that they influence the above-mentioned $K_2$ value. Aside from these elements, the following elements may be further added.

Cu is an element which helps to maintain the strength of steel through aging precipitation and may enhance the corrosion resistance of the steel. Therefore, it is an element of value for improving the characteristics of the material steel. However, since the addition of Cu in a large proportion tends to produce a surface defect, it is necessary to ameliorate this drawback by concomitant addition of Ni. Therefore, in the present invention, Cu and Ni are added in combination and the upper limit for Cu is set at 2.5%. As to Ni, the upper limit is preferably 1.5% from economic points of view.

P may be added as necessary because it can be expected to act as a fortifying element for steel, while it is conducive to improved cold formability at a low level of addition. However, if P is added in excess of 0.2%, the brittleness of the steel becomes remarkable. Therefore, the upper limit for P is set at not more than 0.2% and preferably not more than 0.15%. The recommended lower limit for P is 0.06% from the standpoint of insuring the strength-enhancing effect of laser treatment of ultra-low carbon steels.

The next important elements are Ti and Nb. In the present invention, a high formability of steel and a sufficient gain in strength due to laser treatment are important requirements. From these points of view, ultra-low-carbon steels supplemented with carbonitride formers can be useful materials. The carbonitride-forming elements are added for the precipitation and fixation of C and N in steel matrix and, hence, improved formability. Ti and Nb are the most effective for this purpose. The upper limit is 0.2% for both Ti and Nb and more preferably 0.01 to 0.1% for Ti and 0.005 to 0.1% for Nb. These upper limits are based on economic considerations.

The elements of Zr, V and W are effective in enhancing the strength of steel but the upper limit is 0.1% from economic points of view.

REM and Ca may be added for controlling the morphology of inclusions in steel but the addition of them in excessive amounts result in an increased amount of inclusions to detract from cold formability and toughness. Therefore, the upper limit is 0.02% for each.

Mg is effective in preventing hydrogen embrittlement and may be added for preventing this embrittlement of the laser-treated zone. However, the upper limit is 0.01% from economic points of view.

The unavoidable impurity in the steel of the present invention include not only N and 0 but also Al which is added as a deoxidizer. Al is an element added in the production of aluminum-killed steel. If its proportion exceeds 0.1%, many c-series inclusions are formed to cause surface defects. Therefore, the upper limit for Al is set at 0.1%.

The above-described steel of the invention exhibits excellent cold formability and can be regionally strengthened by laser or other treatment after forming or subjecting areas other than forming areas thereof to such treatment prior to forming so as to insure a markedly increased strength in use.

Since the laser or other treatment according to the present invention is intended to enhance the strength of steel, the areas to be treated should be judicially selected beforehand. Thus, (1) when the area to be formed overlaps the area to be strengthened, it is advisable to form the steel blank to a predetermined shape and then direct the laser beam against the area to be strengthened and (2) when the area to be severely formed is distinct from the area to be strengthened, it is possible to direct the laser beam against the area to be strengthened and, then, subject the blank to forming.

Figure 20A:
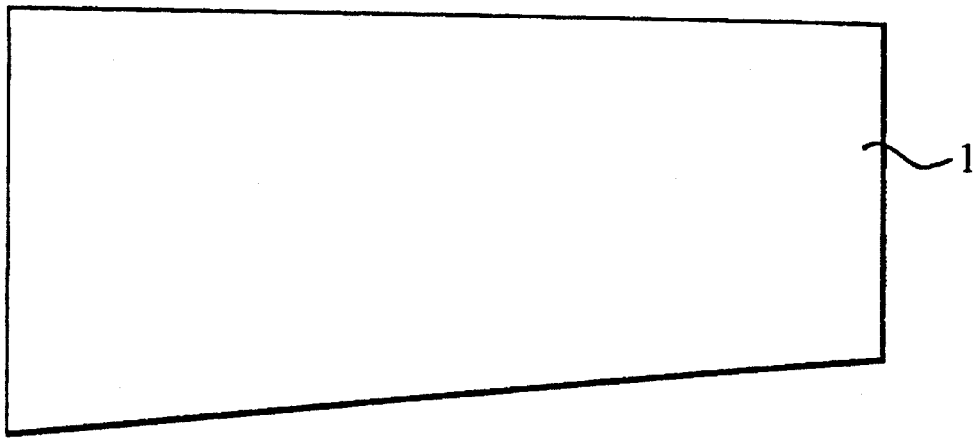
FIGS. 20 20(*a*), 20(*b*) and 20(*c*) are schematic illustrations of laser-treated steel plate and pressed sample.
Figure 20B:
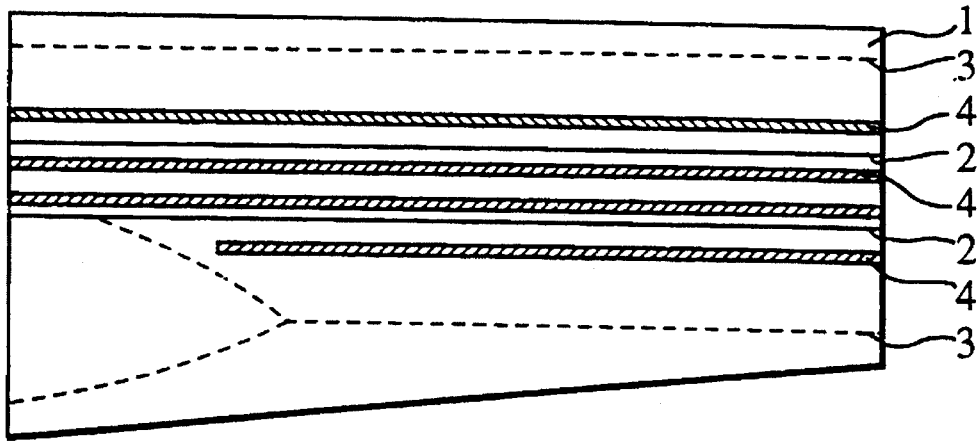
Figure 20C:
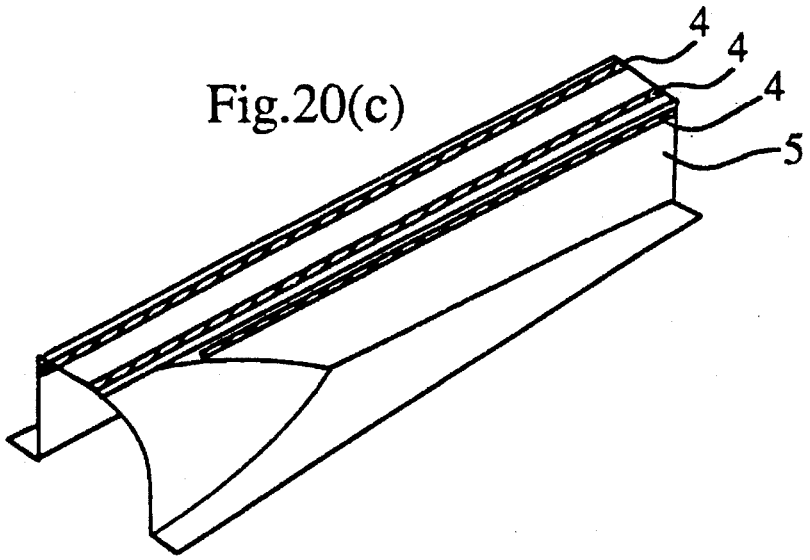

An exemplary case of the latter process is illustrated in FIG. 20. Referring to FIG. 20, the reference numeral 1 stands for a steel blank, 2 for a ridge line, 3 for a valley line, 4 for a laser scanning area, 5 for a formed product (said member). FIG. 20 (*a*) is a plan view of the steel blank, (*b*) an explanatory plan view showing a layout of areas to be formed and areas to be strengthened by laser treatment, and (*c*) is an explanatory plan view showing the appearance of the corresponding formed product. First, a laser beam is directed to the blank avoiding the ridge lines 2 and valley lines 3. Then, the blank is formed to a predetermined shape as shown in (*c*). Of course, even in the case of a member of the shape shown, it is possible to form a blank to said predetermined shape and, then, irradiate the necessary areas with laser light.

The steel according to the present invention can be produced by whichever of hot-rolling-mill and cold-rolling mill processes. The steel of the present invention includes a variety of surface-treated, e.g. galvanized, forms.

Thus, the steel of the invention shows excellent cold formability in the state of a blank and, yet, the necessary parts thereof can be strengthened by laser or other treatment after forming so as to insure a remarkably increased strength in service.

As the steel is formed with a solidification zone extending through its thickness on laser treatment in accordance with the present invention, hardened zones are produced not only along beads but also in the areas adjoining to the beads. On the other hand, when the steel is subjected to rapid heating and the high temperature of the steel is not retained as it is the case with laser treatment, there is no sufficient time for dissolution of carbide grains and homogenization of the alloy constitution. Therefore, the blank steel microstructure and alloy composition which are conducive to said dissolution and homogenization are selectively used in the present invention. Particularly, the choice of the alloy composition and microstructure tailored to the defined laser parameters has very important implications. By this choice, it is made no longer necessary to increase the amounts of carbon and other alloying elements to unnecessary extents and, yet, made possible to insure good blank formability. Since the above effects are realized in the case of the steel according to the present invention, the region to be hardened can be broadened and, therefore, the strength of the steel is remarkably increased. Therefore, it is possible to insure a necessary level of strength in regions other than forming areas by laser treatment and, yet, insure a sufficient degree of formability at the forming stage.

Furthermore, depending on the type of member, only the regions not influencing press forming are strengthened by laser or other treatment. In such cases, it is advantageous to perform laser or other treatment prior to press forming because the treatment can be carried out in a flat state and it is easy to maintain the reliability of characteristics of the blank material. Therefore, even if the strengthening by laser or other treatment is effected before press forming, it is possible to insure both of high product strength and press formability.

Example 1

A steel material of the composition shown in Table 1 was rolled to provide a plate with a thickness of 1.4 mm.

Evaluation of characteristics was performed on two samples, a sample not irradiated with laser light and a sample irradiated with laser light. Particularly, since the evaluation of formability is concerned with the ease of forming, laser treatment was linearly performed using 3 beams at 5 mm intervals. The laser output was 3 kw and the scanning speed was 3 m/min. The focus of laser light was set within the plate so that the molten phase would extend through the thickness. Then, a JIS No. 5 tensile testpiece was prepared with the laser scan line located in the center and subjected to a tensile test.

The results are shown in Table 2. In Table 2, the value before laser treatment represents the result for the tensile testpiece not irradiated with laser light and the carbon steel formability indicator (λ) value represents the result for the testpiece not irradiated with laser light.

TABLE 1

| Steel No. | C (%) | Si (%) | Mn (%) | P (%) | S (%) | Al (%) | Others (%) |
|---|---|---|---|---|---|---|---|
| A-1 | 0.0550 | 0.01 | 0.70 | 0.041 | 0.006 | 0.017 | Ti = 0.02, B = 0.002 |
| A-2 | 0.0460 | 0.01 | 0.69 | 0.041 | 0.005 | 0.018 | Ni = 1.0, CU = 1.0 |
| A-3 | 0.0800 | 1.50 | 0.57 | 0.015 | 0.006 | 0.032 | |
| A-4 | 0.1000 | 0.03 | 0.65 | 0.015 | 0.008 | 0.035 | Nb = 0.15 |
| A-5 | 0.1000 | 0.00 | 0.40 | 0.015 | 0.009 | 0.032 | Cr = 0.50 |
| A-6 | 0.0500 | 0.01 | 0.30 | 0.016 | 0.007 | 0.034 | Mo = 0.05 |
| A-7 | 0.0100 | 0.01 | 0.70 | 0.010 | 0.005 | 0.030 | |
| A-8 | 0.0500 | 0.01 | 0.21 | 0.015 | 0.005 | 0.045 | Cr = 0.05 |
| A-9 | 0.0500 | 0.01 | 1.45 | 0.018 | 0.008 | 0.034 | Ti = 0.11, Zr = 0.025 |
| A-10 | 0.0600 | 0.01 | 1.50 | 0.000 | 0.005 | 0.032 | Cr = 0.50 |
| A-11 | 0.0780 | 0.02 | 1.49 | 0.015 | 0.001 | 0.030 | |
| A-12 | 0.0800 | 0.02 | 1.53 | 0.010 | 0.001 | 0.030 | Nb = 0.03 |
| A-13 | 0.0810 | 0.02 | 1.00 | 0.015 | 0.001 | 0.031 | Ti = 0.02, B = 0.002 |
| A-14 | 0.1000 | 0.01 | 1.31 | 0.080 | 0.006 | 0.030 | Cu = 0.30, Ni = 0.30 |
| A-15 | 0.1500 | 0.02 | 1.49 | 0.016 | 0.001 | 0.030 | |
| A-16 | 0.1500 | 0.02 | 0.99 | 0.014 | 0.001 | 0.031 | Ti = 0.02, B = 0.002 |
| A-17 | 0.1600 | 0.02 | 0.90 | 0.003 | 0.005 | 0.028 | V = 0.05 |
| A-18 | 0.1500 | 0.03 | 0.86 | 0.010 | 0.004 | 0.031 | W = 0.05 |
| A-19 | 0.1500 | 0.03 | 0.55 | 0.014 | 0.004 | 0.030 | Mo = 0.15 |
| A-20 | 0.1500 | 0.02 | 0.98 | 0.010 | 0.005 | 0.030 | Ca = 0.008 |
| A-21 | 0.1500 | 0.03 | 0.99 | 0.015 | 0.006 | 0.028 | REM = 0.008 |
| A-22 | 0.1600 | 0.01 | 0.96 | 0.013 | 0.004 | 0.025 | Mg = 0.001 |

TABLE 2

| | Tensile strength [MPa] | | | Elongation [%] | | | | | | |
|---|---|---|---|---|---|---|---|---|---|---|
| Steel No. | Before laser treatment | After laser treatment | Gain in strength | Before laser treatment | After laser treatment | λ [%] | $K_1$ | $K_2$ | Micro-structure | Remark |
| A-1 | 457.00 | 545.50 | 88.50 | 32.1 | 25.4 | 108.0 | | 0.066 | F + B | Steel of invention |
| A-2 | 439.40 | 516.30 | 76.90 | 33.2 | 26.8 | 114.0 | 0.032 | 0.032 | F + B | Steel of invention |
| A-3 | 480.90 | 570.10 | 89.20 | 29.7 | 22.5 | 134.3 | 0.076 | 0.076 | F + B | Steel of invention |
| A-4 | 469.10 | 549.50 | 80.40 | 29.7 | 20.2 | 113.4 | 0.066 | 0.066 | F + B | Steel of invention |
| A-5 | 418.10 | 510.30 | 92.20 | 33.9 | 23.5 | 116.5 | | 0.090 | F + B | Steel of invention |
| A-6 | 435.60 | 523.40 | 87.80 | 36.3 | 26.2 | 123.6 | | 0.018 | F + B | Steel of invention |
| A-7 | 304.10 | 347.49 | 43.38 | 42.2 | 37.0 | 156.8 | 0.007 | 0.007 | F + B | Control steel |
| A-8 | 399.40 | 442.20 | 42.80 | 39.3 | 32.2 | 123.4 | | 0.013 | F + B | Control steel |
| A-9 | 696.27 | 782.79 | 86.52 | 24.0 | 17.4 | 120.0 | 0.073 | 0.073 | F + B | Steel of invention |
| A-10 | 478.60 | 596.30 | 117.70 | 32.6 | 21.3 | 122.0 | | 0.120 | F + B | Steel of invention |
| A-11 | 441.01 | 561.90 | 120.89 | 37.1 | 23.7 | 142.3 | 0.117 | 0.117 | F + B | Steel of invention |
| A-12 | 490.20 | 599.70 | 109.50 | 33.0 | 22.1 | 120.4 | 0.123 | 0.123 | F + B | Steel of invention |
| A-13 | 436.10 | 558.30 | 122.20 | 36.9 | 23.7 | 134.6 | | 0.122 | F + B | Steel of invention |
| A-14 | 480.30 | 586.40 | 106.10 | 32.0 | 21.9 | 116.2 | 0.131 | 0.131 | F + B | Steel of invention |
| A-15 | 462.58 | 636.80 | 174.22 | 35.4 | 18.3 | 93.7 | 0.224 | 0.224 | F + B | Steel of invention |
| A-16 | 456.30 | 608.70 | 152.40 | 35.2 | 15.8 | 81.6 | | 0.224 | F + B | Steel of invention |
| A-17 | 443.10 | 593.10 | 150.00 | 36.4 | 20.1 | 94.2 | 0.145 | 0.145 | F + B | Steel of invention |

TABLE 2-continued

| Steel No. | Tensile strength [MPa] Before laser treatment | After laser treatment | Gain in strength | Elongation [%] Before laser treatment | After laser treatment | λ [%] | $K_1$ | $K_2$ | Micro-structure | Remark |
|---|---|---|---|---|---|---|---|---|---|---|
| A-18 | 456.80 | 604.50 | 148.00 | 34.8 | 21.0 | 92.1 | 0.130 | 0.130 | F + B | Steel of invention |
| A-19 | 460.50 | 589.40 | 129.40 | 35.6 | 22.1 | 94.6 | | 0.106 | F + B | Steel of invention |
| A-20 | 473.10 | 619.40 | 146.30 | 35.7 | 19.7 | 101.6 | 0.148 | 0.148 | F + B | Steel of invention |
| A-21 | 472.30 | 617.50 | 146.20 | 36.1 | 20.5 | 98.4 | 0.150 | 0.150 | F + B | Steel of invention |
| A-22 | 470.40 | 617.10 | 146.70 | 37.0 | 20.3 | 97.2 | 0.154 | 0.154 | F + B | Steel of invention |

In the case of (A-7), because of the low carbon content of 0.01%, no sufficient gain in strength was realized. In the case of (A-8), because of the low Mn content of 0.21% despite the sufficient carbon content, no sufficient gain in strength was realized.

Example 2

A material of the composition shown in Table 3 was melted and rolled in the same manner as in Example 1 to provide a 1.4 mm-thick plate. The evaluation of characteristics was also carried out in the same manner as in Example 1. The results are shown in Table 4.

TABLE 3

| Steel No. | C (%) | Si (%) | Mn (%) | P (%) | S (%) | Al (%) | Others (%) |
|---|---|---|---|---|---|---|---|
| B-1 | 0.0370 | 0.01 | 0.18 | 0.017 | 0.006 | 0.047 | |
| B-2 | 0.0380 | 0.01 | 0.19 | 0.011 | 0.008 | 0.043 | |
| B-3 | 0.0350 | 0.01 | 0.20 | 0.020 | 0.010 | 0.045 | |
| B-4 | 0.0400 | 0.02 | 0.22 | 0.015 | 0.007 | 0.055 | |
| B-5 | 0.0190 | 0.01 | 0.28 | 0.055 | 0.007 | 0.045 | Cr = 0.05 |
| B-6 | 0.0400 | 0.01 | 0.21 | 0.007 | 0.006 | 0.045 | |
| B-7 | 0.0100 | 0.01 | 0.70 | 0.010 | 0.005 | 0.030 | |
| B-8 | 0.0550 | 0.01 | 0.70 | 0.041 | 0.006 | 0.017 | Nb = 0.02 |
| B-9 | 0.0460 | 0.01 | 0.69 | 0.067 | 0.005 | 0.018 | Ni = 0.3, Cu = 0.3 |
| B-10 | 0.0500 | 0.01 | 0.30 | 0.016 | 0.007 | 0.034 | Mo = 0.05 |
| B-11 | 0.0500 | 0.01 | 0.31 | 0.015 | 0.008 | 0.045 | Cr = 0.05 |
| B-12 | 0.0400 | 0.01 | 0.32 | 0.070 | 0.010 | 0.047 | Ti = 0.02, B = 0.001 |
| B-13 | 0.0550 | 0.01 | 0.70 | 0.016 | 0.006 | 0.017 | Zr = 0.02 |
| B-14 | 0.0460 | 0.01 | 0.69 | 0.014 | 0.008 | 0.018 | W = 0.05 |
| B-15 | 0.0500 | 0.01 | 0.30 | 0.016 | 0.006 | 0.024 | V = 0.05 |
| B-16 | 0.0500 | 0.01 | 0.31 | 0.015 | 0.004 | 0.025 | Ca = 0.005 |
| B-17 | 0.0400 | 0.01 | 0.32 | 0.017 | 0.010 | 0.027 | Mg = 0.001 |
| B-18 | 0.0700 | 0.01 | 0.57 | 0.015 | 0.010 | 0.032 | Ti = 0.12 |
| B-19 | 0.0800 | 1.50 | 0.57 | 0.015 | 0.006 | 0.032 | |
| B-20 | 0.1000 | 0.03 | 0.65 | 0.015 | 0.008 | 0.035 | Nb = 0.15 |
| B-21 | 0.1000 | 0.01 | 0.90 | 0.015 | 0.009 | 0.032 | |
| B-22 | 0.1500 | 0.01 | 0.70 | 0.015 | 0.001 | 0.030 | Ni = 1.1, Cu = 1.1 |
| B-25 | 0.0800 | 0.01 | 1.20 | 0.080 | 0.006 | 0.030 | Ni = 0.3, Cu = 0.3 |
| B-24 | 0.1000 | 0.01 | 0.80 | 0.015 | 0.008 | 0.030 | Nb = 0.15 |
| B-25 | 0.0600 | 0.01 | 0.20 | 0.018 | 0.007 | 0.030 | Cr = 1.0 |
| B-26 | 0.1500 | 0.01 | 0.01 | 0.001 | 0.003 | 0.031 | |
| B-27 | 0.1500 | 0.01 | 0.70 | 0.014 | 0.004 | 0.030 | |
| B-28 | 0.1400 | 0.03 | 0.65 | 0.014 | 0.005 | 0.018 | |
| B-29 | 0.1500 | 0.03 | 0.69 | 0.019 | 0.005 | 0.028 | |
| B-30 | 0.1500 | 0.02 | 0.81 | 0.014 | 0.004 | 0.041 | Cr = 0.15 |
| B-31 | 0.1500 | 0.02 | 0.73 | 0.015 | 0.004 | 0.031 | Zr = 0.15 |
| B-32 | 0.1600 | 0.02 | 0.66 | 0.015 | 0.001 | 0.051 | Ti = 0.10, B = 0.002 |
| B-33 | 0.1600 | 0.02 | 0.90 | 0.003 | 0.005 | 0.028 | V = 0.05 |
| B-34 | 0.1500 | 0.03 | 0.86 | 0.010 | 0.006 | 0.031 | W = 0.05 |
| B-35 | 0.1500 | 0.03 | 0.55 | 0.014 | 0.004 | 0.030 | Mo = 0.15 |
| B-36 | 0.1500 | 0.02 | 0.98 | 0.010 | 0.005 | 0.030 | Ca = 0.006 |
| B-37 | 0.1500 | 0.03 | 0.99 | 0.015 | 0.006 | 0.028 | REM = 0.008 |
| B-38 | 0.1600 | 0.01 | 0.96 | 0.013 | 0.004 | 0.025 | Mg = 0.001 |
| B-39 | 0.1000 | 0.01 | 1.50 | 0.013 | 0.006 | 0.028 | B = 0.004 |

TABLE 4

| Steel No. | Tensile strength [MPa] Before laser treatment | After laser treatment | Gain in strength | Elongation [%] Before laser treatment | After laser treatment | $K_1$ | $K_2$ | Micro-structure | Remark |
|---|---|---|---|---|---|---|---|---|---|
| B-1 | 353.60 | 395.20 | 41.60 | 38.2 | 32.9 | 0.007 | 0.007 | F + C | Control steel |
| B-2 | 346.20 | 381.80 | 35.60 | 37.7 | 33.2 | 0.007 | 0.007 | F + C | Control steel |
| B-3 | 355.30 | 391.60 | 36.30 | 37.6 | 32.9 | 0.007 | 0.007 | F + C | Control steel |
| B-4 | 349.40 | 392.60 | 43.20 | 39.3 | 35.2 | 0.009 | 0.009 | F + C | Control steel |
| B-5 | 370.70 | 414.80 | 44.10 | 42.0 | 32.7 | | 0.006 | F + C | Control steel |
| B-6 | 369.70 | 405.00 | 35.30 | 35.2 | 30.6 | 0.009 | 0.009 | F + P | Control steel |
| B-7 | 197.55 | 219.64 | 22.09 | 40.3 | 34.8 | 0.007 | 0.007 | F + C | Control steel |
| B-8 | 457.00 | 522.50 | 65.50 | 32.1 | 25.4 | 0.039 | 0.039 | F + C | Steel of invention |
| B-9 | 439.40 | 506.30 | 66.90 | 33.2 | 26.8 | 0.032 | 0.032 | F + P | Steel of invention |
| B-10 | 372.10 | 432.00 | 59.90 | 39.4 | 32.2 | | 0.018 | F + P | Steel of invention |
| B-11 | 362.60 | 432.00 | 69.40 | 39.4 | 32.6 | | 0.018 | F + C | Steel of invention |
| B-12 | 372.80 | 442.20 | 69.40 | 37.0 | 30.1 | | 0.023 | F + P | Steel of invention |
| B-13 | 364.00 | 439.50 | 75.50 | 37.1 | 31.4 | 0.039 | 0.039 | F + C | Steel of invention |
| B-14 | 376.40 | 453.30 | 76.90 | 37.2 | 31.8 | 0.032 | 0.032 | F + P | Steel of invention |
| B-16 | 372.10 | 442.00 | 69.90 | 39.4 | 32.2 | 0.015 | 0.015 | F + P | Steel of invention |
| B-16 | 323.60 | 403.00 | 79.40 | 40.4 | 32.6 | 0.016 | 0.016 | F + P | Steel of invention |
| B-17 | 361.80 | 441.20 | 79.40 | 39.5 | 32.1 | 0.013 | 0.013 | F + P | Steel of invention |
| B-18 | 446.20 | 509.70 | 63.50 | 35.6 | 28.3 | 0.040 | 0.040 | F + P | Steel of invention |
| B-19 | 477.60 | 566.80 | 89.20 | 31.8 | 24.6 | 0.076 | 0.076 | F + P | Steel of invention |
| B-20 | 465.80 | 546.20 | 80.40 | 31.8 | 22.7 | 0.066 | 0.066 | F + P | Steel of invention |
| B-21 | 415.80 | 508.00 | 92.20 | 36.0 | 25.6 | 0.090 | 0.090 | F + C | Steel of invention |
| B-22 | 439.34 | 487.18 | 47.84 | 36.7 | 26.8 | 0.105 | 0.105 | Coarse | Control steel |
| B-23 | 480.50 | 582.60 | 102.13 | 35.4 | 27.6 | 0.096 | 0.096 | F + C | Steel of invention |
| B-24 | 462.30 | 546.54 | 84.24 | 34.6 | 24.8 | 0.080 | 0.080 | F + P | Steel of invention |
| B-25 | 442.90 | 537.28 | 94.34 | 36.8 | 27.9 | | 0.072 | F + C | Steel of invention |
| B-26 | 438.10 | 480.00 | 41.90 | 36.8 | 26.4 | 0.002 | 0.002 | F + C | Control steel |
| B-27 | 449.70 | 554.90 | 105.10 | 35.9 | 22.3 | 0.105 | 0.105 | F + C | Steel of invention |
| B-28 | 445.40 | 553.40 | 108.00 | 33.4 | 25.0 | 0.092 | 0.092 | F + C | Steel of invention |
| B-29 | 459.20 | 589.70 | 130.50 | 34.1 | 24.1 | 0.105 | 0.105 | F + P | Steel of invention |
| B-30 | 468.50 | 602.70 | 134.20 | 35.7 | 17.3 | | 0.145 | F + C | Steel of invention |
| B-31 | 461.00 | 598.70 | 137.70 | 35.7 | 20.9 | 0.110 | 0.110 | F + C | Steel of invention |
| B-32 | 436.50 | 580.40 | 143.90 | 36.0 | 22.4 | | 0.186 | F + C | Steel of invention |
| B-33 | 447.20 | 578.70 | 131.50 | 35.9 | 22.0 | 0.145 | 0.145 | F + C | Steel of invention |
| B-34 | 458.00 | 588.70 | 130.70 | 33.4 | 25.0 | 0.130 | 0.130 | F + C | Steel of invention |
| B-35 | 456.50 | 561.90 | 105.40 | 34.9 | 21.8 | | 0.106 | F + C | Steel of invention |
| B-36 | 476.00 | 602.80 | 126.80 | 34.4 | 22.0 | 0.148 | 0.148 | F + C | Steel of invention |
| B-37 | 475.80 | 602.55 | 126.75 | 33.7 | 21.5 | 0.150 | 0.150 | F + C | Steel of invention |
| B-38 | 474.20 | 601.60 | 127.40 | 33.1 | 22.1 | 0.154 | 0.154 | F + C | Steel of invention |
| B-39 | 452.00 | 603.20 | 51.20 | 34.0 | 22.0 | | 0.250 | F + C | Steel of invention |

In (B-1) through (B-7), because $K_1$ is smaller than 0.01, no sufficient enhancement of strength could be realized. In (B-22), because of its spheroidized carbide structure, despite a large $K_1$ value, no sufficient enhancement of strength was realized. As to (B-26), because of its small $K_1$ value of 0.02, despite the ferrite+perlite structure, no sufficient enhancement of strength was realized. In (B-8) and (B-9), improvements in steel strength were realized by the addition of Nb or P, Cu and Ni and with $K_1$ values being larger than 0.01, sufficient gains in strength were realized.

Example 3

A material of the composition shown in Table 5 was melted and rolled as in Example 1 to provide a 1.4 mm thick plate. Evaluation of characteristics was also carried out in the same manner as in Example 1. The results are shown in Table 6.

TABLE 5

| Steel No. | C (%) | Si (%) | Mn (%) | P (%) | S (%) | Al (%) | Ti (%) | Others (%) |
|---|---|---|---|---|---|---|---|---|
| C-1 | 0.0008 | 0.01 | 0.01 | 0.004 | 0.003 | 0.030 | 0.002 | |
| C-2 | 0.0012 | 0.01 | 0.02 | 0.005 | 0.002 | 0.030 | 0.024 | |
| C-3 | 0.0030 | 0.01 | 0.14 | 0.015 | 0.004 | 0.038 | 0.030 | |
| C-4 | 0.0020 | 0.02 | 0.16 | 0.016 | 0.005 | 0.047 | 0.050 | |
| C-5 | 0.0020 | 0.02 | 0.10 | 0.015 | 0.004 | 0.038 | 0.020 | Nb = 0.01 |
| C-6 | 0.0030 | 0.01 | 0.16 | 0.013 | 0.004 | 0.038 | 0.010 | Nb = 0.02, B = 0.001 |
| C-7 | 0.0020 | 0.02 | 0.56 | 0.011 | 0.005 | 0.033 | 0.090 | |
| C-8 | 0.0020 | 0.01 | 0.20 | 0.015 | 0.004 | 0.025 | 0.050 | |
| C-9 | 0.0020 | 0.01 | 0.25 | 0.015 | 0.005 | 0.048 | 0.050 | Mo = 0.05 |
| C-10 | 0.0051 | 0.49 | 0.99 | 0.010 | 0.005 | 0.029 | 0.053 | |
| C-11 | 0.0050 | 0.01 | 1.48 | 0.080 | 0.004 | 0.032 | 0.015 | Nb = 0.036, Ni = 1.0, Cu = 1.0, B = 0.001 |
| C-12 | 0.0050 | 0.01 | 1.48 | 0.010 | 0.004 | 0.032 | 0.015 | Nb = 0.036 |

TABLE 5-continued

| Steel No. | C (%) | Si (%) | Mn (%) | P (%) | S (%) | Al (%) | Ti (%) | Others (%) |
|---|---|---|---|---|---|---|---|---|
| C-13 | 0.0051 | 0.25 | 1.20 | 0.100 | 0.005 | 0.035 | 0.015 | Nb = 0.10, B = 0.0014 |
| C-14 | 0.0050 | 0.01 | 1.51 | 0.010 | 0.005 | 0.030 | 0.056 | |
| C-15 | 0.0052 | 0.01 | 0.50 | 0.010 | 0.005 | 0.032 | 0.055 | Cr = 1.00 |
| C-16 | 0.0051 | 0.01 | 1.00 | 0.010 | 0.005 | 0.031 | 0.054 | Mo = 0.55 |
| C-17 | 0.0054 | 0.49 | 1.49 | 0.010 | 0.004 | 0.028 | 0.054 | |
| C-18 | 0.0054 | 0.50 | 1.99 | 0.010 | 0.005 | 0.027 | 0.055 | |
| C-19 | 0.0050 | 0.25 | 1.20 | 0.100 | 0.005 | 0.030 | 0.090 | V = 0.025, B = 0.002 |
| C-20 | 0.0050 | 0.25 | 1.20 | 0.100 | 0.004 | 0.030 | 0.090 | Zr = 0.025, B = 0.002 |
| C-21 | 0.0050 | 0.25 | 1.20 | 0.100 | 0.004 | 0.030 | 0.090 | W = 0.025, B = 0.002 |
| C-22 | 0.0050 | 0.25 | 1.20 | 0.100 | 0.004 | 0.030 | 0.090 | Ca = 0.005, B = 0.002 |
| C-23 | 0.0050 | 0.25 | 1.20 | 0.100 | 0.005 | 0.030 | 0.090 | REM = 0.005, B = 0.002 |
| C-24 | 0.0050 | 0.25 | 1.20 | 0.100 | 0.004 | 0.030 | 0.090 | Mg = 0.001, B = 0.002 |
| C-25 | 0.0100 | 0.01 | 1.20 | 0.100 | 0.004 | 0.030 | 0.090 | Nb = 0.025, B = 0.002 |
| C-26 | 0.0200 | 0.01 | 1.20 | 0.020 | 0.004 | 0.030 | 0.100 | Nb = 0.025, B = 0.002 |
| C-27 | 0.0300 | 0.01 | 1.20 | 0.020 | 0.004 | 0.030 | 0.120 | Nb = 0.025, B = 0.002 |
| C-28 | 0.0008 | 0.01 | 0.01 | 0.004 | 0.002 | 0.030 | | |
| C-29 | 0.0012 | 0.01 | 0.02 | 0.005 | 0.003 | 0.030 | | |
| C-30 | 0.0025 | 0.01 | 0.15 | 0.015 | 0.003 | 0.032 | | |
| C-31 | 0.0031 | 0.01 | 0.16 | 0.011 | 0.003 | 0.017 | | B = 0.001 |
| C-32 | 0.0022 | 0.02 | 0.73 | 0.013 | 0.004 | 0.032 | | |
| C-33 | 0.0050 | 0.01 | 0.67 | 0.011 | 0.005 | 0.030 | | |
| C-34 | 0.0054 | 0.49 | 1.53 | 0.013 | 0.004 | 0.028 | | |
| C-35 | 0.0056 | 0.50 | 2.13 | 0.015 | 0.004 | 0.029 | | |
| C-36 | 0.0050 | 0.25 | 1.18 | 0.094 | 0.003 | 0.019 | | B = 0.002 |
| C-37 | 0.0110 | 0.01 | 1.19 | 0.022 | 0.004 | 0.014 | | B = 0.002 |
| C-38 | 0.0210 | 0.01 | 1.23 | 0.021 | 0.003 | 0.016 | | B = 0.002 |

TABLE 6

| | Yield strength [MPa] | | | Tensile strength [MPa] | | | Elongation [%] | | | | |
|---|---|---|---|---|---|---|---|---|---|---|---|
| Steel No. | Before laser treatment | After laser treatment | Gain in strength | Before laser treatment | After laser treatment | Gain in strength | Before laser treatment | After laser treatment | r | T | Remark |
| C-1 | 111.00 | 119.41 | 8.41 | 243.40 | 248.83 | 5.43 | 58.6 | 53.8 | 2.1 | 0.0001 | Control steel |
| C-2 | 105.00 | 114.64 | 9.64 | 248.10 | 254.50 | 6.40 | 56.4 | 52.4 | 2.1 | 0.001 | Control steel |
| C-3 | 178.00 | 200.40 | 22.40 | 286.50 | 307.00 | 20.50 | 50.5 | 46.3 | 1.8 | 0.0013 | Steel of invention |
| C-4 | 176.80 | 203.30 | 26.50 | 289.00 | 305.60 | 16.60 | 50.4 | 45.5 | 1.8 | 0.0010 | Steel of invention |
| C-5 | 172.30 | 199.70 | 27.40 | 294.20 | 307.60 | 13.40 | 51.3 | 46.4 | 1.8 | 0.0008 | Steel of invention |
| C-6 | 165.10 | 204.50 | 39.40 | 299.10 | 321.90 | 22.80 | 49.5 | 45.1 | 1.8 | 0.0020 | Steel of invention |
| C-7 | 171.00 | 206.00 | 35.00 | 298.60 | 318.10 | 19.50 | 52.7 | 48.8 | 1.7 | 0.0016 | Steel of invention |
| C-8 | 190.25 | 215.75 | 25.50 | 294.20 | 325.60 | 31.40 | 49.0 | 41.0 | 1.7 | 0.0010 | Steel of invention |
| C-9 | 161.81 | 196.13 | 34.32 | 295.20 | 309.90 | 14.70 | 50.0 | 45.7 | 1.8 | 0.0011 | Steel of invention |
| C-10 | 203.00 | 246.15 | 43.15 | 395.89 | 417.08 | 21.18 | 39.0 | 35.2 | 1.5 | 0.0067 | Steel of invention |
| C-11 | 275.60 | 366.50 | 90.90 | 449.10 | 516.70 | 67.60 | 36.8 | 28.4 | 1.4 | 0.0167 | Steel of invention |
| C-12 | 234.08 | 273.50 | 39.42 | 383.44 | 403.35 | 19.91 | 39.5 | 35.4 | 1.5 | 0.0102 | Steel of invention |
| C-13 | 314.79 | 408.94 | 94.14 | 465.80 | 526.60 | 60.80 | 36.2 | 27.5 | 1.4 | 0.0184 | Steel of invention |
| C-14 | 223.59 | 255.95 | 32.36 | 363.53 | 386.09 | 22.56 | 42.2 | 37.3 | 1.5 | 0.0086 | Steel of invention |
| C-15 | 220.41 | 264.13 | 43.72 | 361.06 | 385.14 | 24.08 | 42.3 | 38.0 | 1.5 | 0.0037 | Steel of invention |
| C-16 | 222.74 | 253.54 | 30.80 | 362.87 | 385.02 | 22.15 | 42.0 | 37.1 | 1.4 | 0.0061 | Steel of invention |
| C-17 | 250.07 | 291.55 | 41.48 | 408.64 | 437.67 | 29.03 | 38.0 | 33.4 | 1.4 | 0.0098 | Steel of invention |
| C-18 | 259.59 | 336.07 | 76.84 | 433.75 | 470.43 | 36.68 | 37.5 | 30.9 | 1.5 | 0.0125 | Steel of invention |
| C-19 | 309.54 | 398.69 | 89.15 | 451.60 | 516.98 | 65.38 | 36.8 | 28.6 | 1.4 | 0.0188 | Steel of invention |
| C-20 | 310.25 | 402.78 | 92.53 | 449.23 | 514.20 | 64.97 | 37.1 | 28.8 | 1.5 | 0.0188 | Steel of invention |
| C-21 | 313.56 | 405.08 | 91.52 | 461.38 | 527.27 | 65.89 | 36.6 | 28.5 | 1.5 | 0.0188 | Steel of invention |
| C-22 | 310.81 | 401.35 | 90.54 | 448.21 | 514.93 | 66.72 | 37.0 | 28.7 | 1.4 | 0.0188 | Steel of invention |
| C-23 | 311.56 | 404.68 | 93.13 | 450.37 | 518.74 | 68.37 | 36.9 | 28.6 | 1.5 | 0.0188 | Steel of invention |
| C-24 | 308.61 | 399.22 | 90.61 | 449.68 | 514.57 | 64.89 | 37.2 | 29.0 | 1.5 | 0.0188 | Steel of invention |
| C-25 | 321.57 | 427.00 | 105.43 | 460.91 | 537.74 | 76.83 | 36.7 | 28.4 | 1.4 | 0.0370 | Steel of invention |
| C-26 | 335.19 | 468.86 | 133.67 | 463.82 | 554.19 | 90.37 | 36.4 | 28.5 | 1.4 | 0.0421 | Steel of invention |
| C-27 | 338.70 | 465.42 | 126.72 | 498.67 | 615.09 | 116.42 | 36.2 | 28.2 | 1.1 | 0.0631 | Control steel |
| C-28 | 116.00 | 123.61 | 7.61 | 250.60 | 255.6 | 5.0 | 56.4 | 62.4 | 1.8 | 0.0001 | Control steel |
| C-29 | 112.00 | 120.54 | 8.54 | 255.40 | 261.4 | 6.0 | 55.2 | 50.3 | 1.7 | 0.0001 | Control steel |
| C-30 | 182.00 | 202.40 | 20.40 | 294.30 | 313.7 | 19.4 | 49.8 | 45.2 | 1.5 | 0.0011 | Steel of invention |
| C-31 | 185.10 | 222.70 | 37.60 | 304.70 | 320.1 | 15.4 | 49.2 | 44.9 | 1.5 | 0.0020 | Steel of invention |
| C-32 | 181.00 | 214.10 | 33.10 | 306.70 | 319.1 | 12.4 | 50.3 | 48.1 | 1.6 | 0.0022 | Steel of invention |
| C-33 | 233.59 | 263.75 | 30.16 | 376.40 | 395.8 | 19.4 | 41.9 | 38.0 | 1.3 | 0.0045 | Steel of invention |
| C-34 | 260.07 | 299.27 | 39.20 | 413.60 | 439.0 | 25.4 | 38.2 | 32.9 | 1.3 | 0.0103 | Steel of invention |
| C-35 | 265.59 | 341.85 | 76.26 | 441.70 | 473.3 | 31.6 | 37.9 | 30.1 | 1.4 | 0.0143 | Steel of invention |
| C-36 | 316.54 | 403.70 | 87.16 | 456.80 | 519.2 | 62.4 | 46.5 | 28.1 | 1.3 | 0.0181 | Steel of invention |

TABLE 6-continued

| Steel No. | Yield strength [MPa] Before laser treatment | After laser treatment | Gain in strength | Tensile strength [MPa] Before laser treatment | After laser treatment | Gain in strength | Elongation [%] Before laser treatment | After laser treatment | r | T | Remark |
|---|---|---|---|---|---|---|---|---|---|---|---|
| C-37 | 329.57 | 431.88 | 102.31 | 462.10 | 535.6 | 73.5 | 36.4 | 28.1 | 1.3 | 0.0235 | Steel of invention |
| C-38 | 342.80 | 453.50 | 110.70 | 465.80 | 553.4 | 87.6 | 36.1 | 27.9 | 1.3 | 0.0452 | Steel of invention |

In (C-28) and (C-29), because of low C and Mn contents, the strength enhancing effect of laser treatment is not appreciable. In (C-27), because of a large C content, the $\gamma$ value is as small as 1.1. In (C-1) and (C-2), which are Ti-free aluminum-killed steels, the strength-enhancing effect of laser treatment is not appreciable, either, because of small C and Mn contents.

Figure 23:
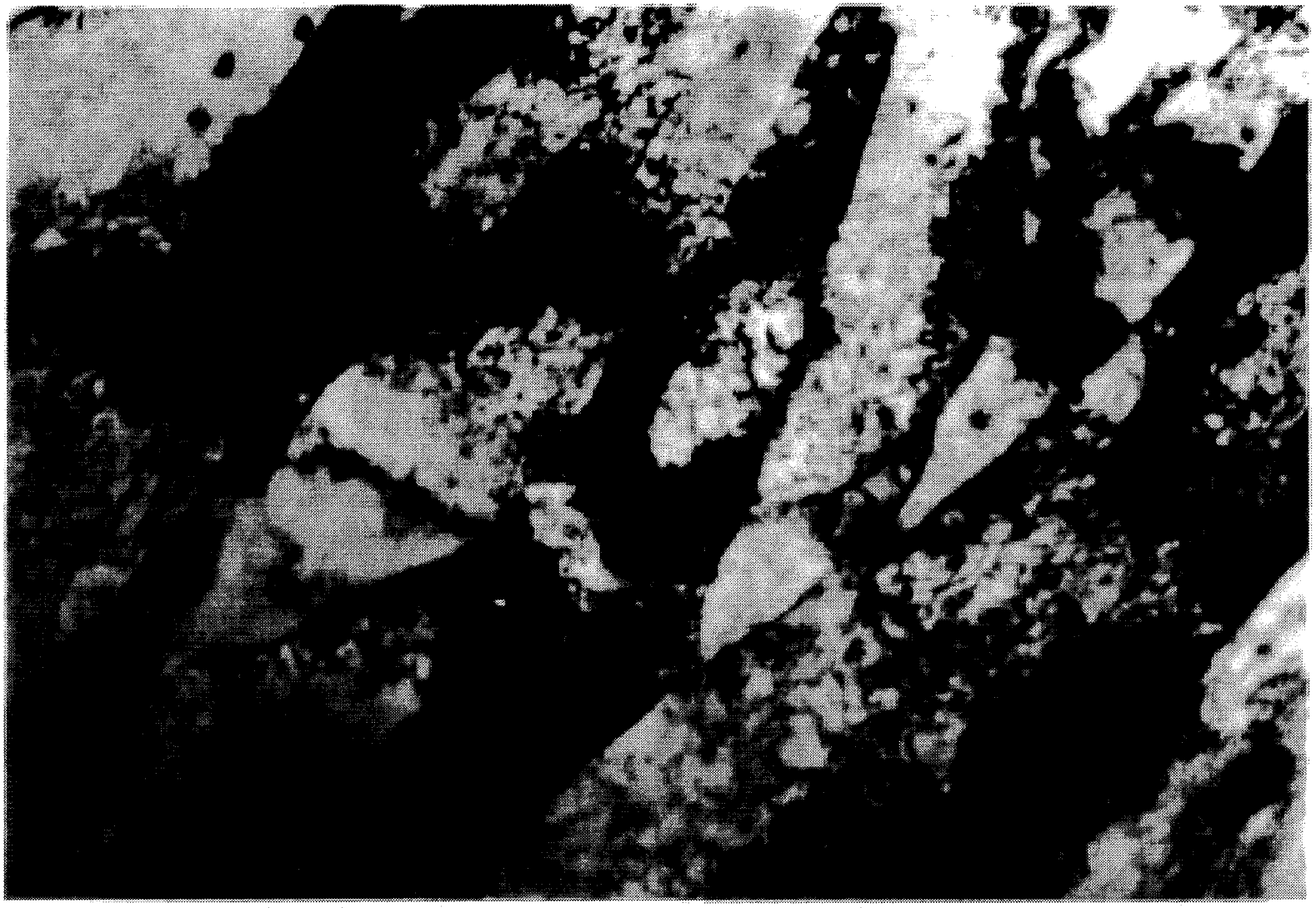
FIG. 23 is a TEM photograph showing the laser-treated zone of a steel plate of the invention (C-11 in Table 5).

FIG. 23 is an electron micrograph (x 15,000) of the laser-treated zone of (C-11).

Example 4

A material of the composition shown in Table 7 was melted and rolled as in Example 1 to provide a 1.4 mm thick plate. Evaluation of characteristics was also carried out in the same manner as in Example 1. The results are shown in Table 8.

TABLE 7

| Steel No. | C (%) | Si (%) | Mn (%) | P (%) | S (%) | Al (%) | Others(%) |
|---|---|---|---|---|---|---|---|
| D-1 | 0.0550 | 0.00 | 0.70 | 0.041 | 0.005 | 0.030 | Ti = 0.020, B = 0.002 |
| D-2 | 0.0460 | 0.00 | 0.69 | 0.041 | 0.006 | 0.031 | Nb = 0.020 |
| D-3 | 0.0800 | 1.50 | 0.57 | 0.015 | 0.004 | 0.032 | |
| D-4 | 0.1000 | 0.03 | 0.65 | 0.015 | 0.005 | 0.030 | Mo = 0.015 |
| D-5 | 0.1000 | 0.00 | 0.40 | 0.015 | 0.006 | 0.029 | Cr = 0.5 |
| D-6 | 0.0100 | 0.01 | 0.70 | 0.010 | 0.006 | 0.030 | |
| D-7 | 0.0400 | 0.00 | 0.21 | 0.007 | 0.004 | 0.030 | |
| D-8 | 0.1000 | 1.00 | 1.00 | 0.018 | 0.006 | 0.033 | Cr = 0.5, Zr = 0.02 |
| D-9 | 0.1000 | 1.20 | 0.90 | 0.018 | 0.004 | 0.030 | Cr = 0.2, Mo = 1.0 |
| D-10 | 0.1000 | 1.20 | 0.90 | 0.018 | 0.005 | 0.034 | Cr = 1.0, Ca = 0.008 |
| D-11 | 0.1000 | 1.20 | 1.40 | 0.018 | 0.004 | 0.030 | Cr = 0.5, REM = 0.008 |
| D-12 | 0.1000 | 1.20 | 1.40 | 0.018 | 0.005 | 0.034 | Cr = 0.5, Mg = 0.001 |
| D-13 | 0.1200 | 1.50 | 1.50 | 0.015 | 0.004 | 0.030 | Cr = 0.5, W = 0.05 |
| D-14 | 0.1200 | 1.20 | 1.50 | 0.015 | 0.006 | 0.034 | Cr = 0.5, V = 0.5 |
| D-15 | 0.0600 | 0.00 | 0.80 | 0.000 | 0.004 | 0.032 | Cr = 1.2 |
| D-16 | 0.0800 | 0.02 | 1.53 | 0.010 | 0.005 | 0.031 | Nb = 0.10 |
| D-17 | 0.0810 | 0.02 | 1.00 | 0.015 | 0.006 | 0.031 | Ti = 0.10, B = 0.002 |
| D-18 | 0.1000 | 0.00 | 1.31 | 0.080 | 0.005 | 0.029 | Ni = 0.1, Cu = 0.10 |
| D-19 | 0.1500 | 0.02 | 1.49 | 0.016 | 0.004 | 0.034 | |
| D-20 | 0.1500 | 0.02 | 0.99 | 0.014 | 0.004 | 0.034 | Ti = 0.02, B = 0.002 |

TABLE 8

| Steel No. | Yield strength [MPa] Before laser treatment | After laser treatment | Gain in strength | Tensile strength [MPa] Before laser treatment | After laser treatment | Gain in strength | Yeild ratio [%] Before laser treatment | Elongation [%] Before laser treatment | $K_1$ | $K_2$ | Micro-structure | Remark |
|---|---|---|---|---|---|---|---|---|---|---|---|---|
| D-1 | 273.80 | 356.70 | 82.90 | 435.40 | 512.90 | 77.50 | 62.88 | 36.4 | | 0.066 | M + B + F | Steel of Invention |
| D-2 | 264.30 | 315.10 | 50.80 | 450.80 | 508.20 | 57.40 | 58.63 | 35.4 | 0.032 | 0.032 | M + B + F | Steel of Invention |
| D-3 | 334.82 | 410.42 | 75.60 | 520.70 | 564.80 | 44.10 | 64.30 | 35.1 | 0.076 | 0.076 | M + B + F | Steel of Invention |
| D-4 | 346.80 | 416.80 | 70.00 | 521.60 | 567.20 | 45.60 | 66.49 | 32.6 | | 0.067 | M + B + F | Steel of Invention |
| D-5 | 308.10 | 384.90 | 76.80 | 519.80 | 566.10 | 46.30 | 59.27 | 33.8 | | 0.090 | M + B + F | Steel of Invention |
| D-6 | 212.98 | 230.40 | 17.42 | 387.60 | 428.40 | 40.50 | 54.95 | 40.3 | 0.007 | 0.007 | M + B + F | Control steel |
| D-7 | 260.40 | 283.80 | 23.40 | 453.80 | 483.70 | 29.90 | 57.38 | 37.2 | 0.008 | 0.008 | M + B + F | Control steel |
| D-8 | 434.43 | 538.40 | 103.97 | 578.59 | 647.96 | 69.40 | 75.08 | 33.0 | | 0.175 | M + B + F | Steel of Invention |
| D-9 | 635.47 | 733.87 | 98.40 | 747.27 | 809.57 | 62.30 | 85.04 | 27.0 | | 0.240 | M + B + F | Steel of Invention |

TABLE 8-continued

| Steel No. | Yield strength [MPa] Before laser treatment | Yield strength [MPa] After laser treatment | Yield strength [MPa] Gain in strength | Tensile strength [MPa] Before laser treatment | Tensile strength [MPa] After laser treatment | Tensile strength [MPa] Gain in strength | Yeild ratio [%] Before laser treatment | Elongation [%] Before laser treatment | $K_1$ | $K_2$ | Micro-structure | Remark |
|---|---|---|---|---|---|---|---|---|---|---|---|---|
| D-10 | 634.43 | 728.40 | 93.97 | 778.59 | 837.96 | 59.40 | 81.48 | 26.8 | | 0.220 | M + B + F | Steel of Invention |
| D-11 | 636.48 | 731.28 | 94.80 | 777.21 | 837.31 | 60.10 | 81.89 | 27.1 | | 0.220 | M + B + F | Steel of Invention |
| D-12 | 642.34 | 739.62 | 97.28 | 777.14 | 835.64 | 58.50 | 82.65 | 26.7 | | 0.220 | M + B + F | Steel of Invention |
| D-13 | 704.87 | 799.97 | 95.10 | 785.30 | 869.70 | 84.40 | 88.74 | 21.3 | | 0.285 | M + B + F | Steel of Invention |
| D-14 | 810.03 | 899.43 | 89.40 | 900.25 | 950.55 | 50.30 | 89.90 | 19.0 | | 0.276 | M + B + F | Steel of Invention |
| D-15 | 298.40 | 393.08 | 94.68 | 475.20 | 570.80 | 95.60 | 62.79 | 37.9 | | 0.120 | M + B + F | Steel of Invention |
| D-16 | 384.10 | 481.30 | 97.20 | 518.40 | 599.80 | 81.40 | 74.09 | 33.4 | 0.123 | 0.123 | M + B + F | Steel of Invention |
| D-17 | 355.00 | 457.30 | 102.30 | 497.20 | 602.00 | 104.80 | 71.40 | 32.6 | | 0.122 | M + B + F | Steel of Invention |
| D-18 | 453.40 | 558.10 | 104.70 | 607.10 | 701.80 | 94.70 | 74.68 | 28.7 | 0.131 | 0.131 | M + B + F | Steel of Invention |
| D-19 | 366.40 | 470.10 | 103.70 | 508.10 | 646.00 | 137.90 | 72.11 | 36.8 | 0.224 | 0.224 | M + B + F | Steel of Invention |
| D-20 | 387.40 | 483.80 | 96.40 | 512.70 | 655.50 | 142.80 | 75.56 | 37.2 | | 0.224 | M + B + F | Steel of Invention |

The strength-enhancing effect of laser treatment is not appreciable in (D-6) because of a low level of C and in (D-7) which is lean in Mn.

Example 5

A material of the composition shown in Table 9 was melted and rolled as in Example 1 to provide a 1.4 mm thick plate. Evaluation of characteristics was also carried out in the same manner as in Example 1. The results are shown in Table 10.

TABLE 9

| Steel No. | C (%) | Si (%) | Mn (%) | P (%) | S (%) | Al (%) | Others (%) |
|---|---|---|---|---|---|---|---|
| E-1 | 0.160 | 1.510 | 1.480 | 0.010 | 0.004 | 0.052 | |
| E-2 | 0.200 | 1.990 | 1.490 | 0.009 | 0.005 | 0.050 | |
| E-3 | 0.210 | 1.500 | 1.500 | 0.080 | 0.005 | 0.051 | Cu = 1.0, Ni = 1.0 |
| E-4 | 0.190 | 1.480 | 1.480 | 0.010 | 0.005 | 0.048 | Nb = 0.12 |
| E-5 | 0.190 | 1.510 | 0.980 | 0.010 | 0.004 | 0.052 | Cr = 1.110 |
| E-6 | 0.188 | 1.480 | 0.700 | 0.010 | 0.005 | 0.048 | Mo = 1.01 |
| E-7 | 0.190 | 1.490 | 1.490 | 0.009 | 0.004 | 0.042 | V = 0.019 |
| E-8 | 0.192 | 1.510 | 1.480 | 0.011 | 0.004 | 0.043 | W = 0.07 |
| E-9 | 0.191 | 1.520 | 1.510 | 0.011 | 0.006 | 0.045 | Ti = 0.10, B = 0.002 |
| E-10 | 0.190 | 1.510 | 1.490 | 0.010 | 0.004 | 0.038 | Zr = 0.02 |
| E-11 | 0.189 | 1.490 | 1.520 | 0.008 | 0.006 | 0.039 | Ca = 0.007 |
| E-12 | 0.190 | 1.480 | 1.510 | 0.010 | 0.005 | 0.034 | REM = 0.008 |
| E-13 | 0.193 | 1.480 | 1.480 | 0.008 | 0.004 | 0.051 | Mg = 0.001 |
| E-14 | 0.120 | 1.500 | 1.500 | 0.010 | 0.005 | 0.003 | |
| E-15 | 0.010 | 1.000 | 1.010 | 0.009 | 0.005 | 0.026 | |

TABLE 10

| Steel No. | Yield strength [MPa] Before laser treatment | After laser treatment | Gain in strength | Tensile strength [MPa] Before laser treatment | After laser treatment | Gain in strength | Elongation [%] Before laser treatment | $K_1$ | $K_2$ | Micro-structure | Remark |
|---|---|---|---|---|---|---|---|---|---|---|---|
| E-1 | 556.03 | 735.20 | 178.60 | 781.60 | 919.30 | 137.70 | 32.90 | 0.297 | 0.297 | F + γ + M + B | Steel of invention |
| E-2 | 534.46 | 753.10 | 218.60 | 835.50 | 965.14 | 129.64 | 35.10 | 0.398 | 0.398 | F + γ + M + B | Steel of invention |
| E-3 | 684.70 | 899.40 | 214.70 | 1021.18 | 1139.40 | 118.40 | 30.90 | 0.394 | 0.394 | F + γ + M + B | Steel of invention |
| E-4 | 560.80 | 771.20 | 210.40 | 794.60 | 938.30 | 143.70 | 31.80 | 0.352 | 0.352 | F + γ + M + B | Steel of invention |
| E-5 | 524.66 | 749.30 | 224.60 | 920.65 | 1044.50 | 123.80 | 30.10 | | 0.450 | F + γ + M + B | Steel of invention |
| E-6 | 548.60 | 767.24 | 218.64 | 787.10 | 950.90 | 163.80 | 32.00 | | 0.391 | F + γ + M + B | Steel of invention |
| E-7 | 553.10 | 766.80 | 213.70 | 784.30 | 936.10 | 151.80 | 31.70 | 0.354 | 0.354 | F + γ + M + B | Steel of invention |
| E-8 | 556.40 | 768.94 | 212.54 | 789.60 | 936.00 | 146.40 | 31.60 | 0.357 | 0.357 | F + γ + M + B | Steel of invention |
| E-9 | 567.90 | 804.60 | 236.70 | 796.80 | 965.50 | 168.70 | 32.40 | | 0.456 | F + γ + M + B | Steel of invention |
| E-10 | 564.20 | 771.80 | 207.60 | 791.60 | 934.40 | 142.80 | 31.80 | 0.355 | 0.355 | F + γ + M + B | Steel of invention |
| E-11 | 557.60 | 764.40 | 206.80 | 796.30 | 941.60 | 145.60 | 31.90 | 0.358 | 0.358 | F + γ + M + B | Steel of invention |
| E-12 | 562.40 | 768.10 | 205.70 | 792.40 | 936.10 | 143.70 | 31.80 | 0.357 | 0.357 | F + γ + M + B | Steel of invention |
| E-13 | 559.30 | 768.60 | 209.30 | 793.80 | 934.40 | 140.60 | 32.00 | 0.357 | 0.357 | F + γ + M + B | Steel of invention |
| E-14 | 453.10 | 636.70 | 183.40 | 648.70 | 764.10 | 115.40 | 37.60 | 0.225 | 0.225 | F + γ + B | Steel of invention |
| E-15 | 422.10 | 468.01 | 45.91 | 631.00 | 696.50 | 65.50 | 34.00 | 0.126 | 0.126 | F + γ + M + B | Control steel |

In (E-15), because of a low carbon content of 0.01%, no sufficient enhancement of strength could be obtained.

Example 6

A material of the composition shown in Table 11 was melted and rolled as in Example 1 to provide a 1.4 mm thick plate. Evaluation of characteristics was also carried out in the same manner as in Example 1. The results are shown in Table 12.

TABLE 11

| Steel No. | C (%) | Si (%) | Mn (%) | P (%) | S (%) | Al (%) | Others (%) |
|---|---|---|---|---|---|---|---|
| F-1 | 0.0550 | 0.01 | 0.70 | 0.041 | 0.006 | 0.017 | Ti = 0.020, B = 0.002 |
| F-2 | 0.0460 | 0.01 | 0.69 | 0.041 | 0.005 | 0.018 | Ni = 1.0, Cu = 1.0 |
| F-3 | 0.0800 | 1.50 | 0.57 | 0.015 | 0.006 | 0.032 | |
| F-4 | 0.1000 | 0.03 | 0.65 | 0.015 | 0.008 | 0.035 | Nb = 0.15 |
| F-5 | 0.1000 | 0.01 | 0.40 | 0.015 | 0.009 | 0.032 | Cr = 0.5 |
| F-6 | 0.0500 | 0.01 | 0.30 | 0.016 | 0.007 | 0.034 | MO = 0.05 |
| F-7 | 0.0100 | 0.01 | 0.70 | 0.010 | 0.005 | 0.030 | |
| F-8 | 0.0400 | 0.01 | 0.21 | 0.007 | 0.005 | 0.045 | |
| F-9 | 0.0500 | 0.50 | 1.50 | 0.018 | 0.007 | 0.032 | Ti = 0.1 50, Nb = 0.032 |
| F-10 | 0.1400 | 0.20 | 1.70 | 0.015 | 0.005 | 0.032 | |
| F-11 | 0.0600 | 0.01 | 0.80 | 0.000 | 0.005 | 0.032 | Cr = 1.2 |
| F-12 | 0.0800 | 0.02 | 1.53 | 0.010 | 0.001 | 0.030 | Nb = 0.030 |
| F-13 | 0.0810 | 0.02 | 1.00 | 0.015 | 0.001 | 0.031 | Ti = 0.02, B = 0.002 |
| F-14 | 0.1000 | 0.01 | 1.31 | 0.080 | 0.006 | 0.030 | Cu = 0.30, Ni = 0.30 |
| F-15 | 0.1500 | 0.02 | 1.49 | 0.016 | 0.001 | 0.030 | |
| F-16 | 0.1500 | 0.02 | 0.99 | 0.014 | 0.001 | 0.031 | Ti = 0.02, B = 0.002 |
| F-17 | 0.1600 | 0.02 | 0.90 | 0.003 | 0.005 | 0.028 | V = 0.05 |
| F-18 | 0.1500 | 0.03 | 0.86 | 0.010 | 0.004 | 0.031 | W = 0.05 |
| F-19 | 0.1500 | 0.03 | 0.55 | 0.014 | 0.004 | 0.030 | MO = 0.15 |
| F-20 | 0.1500 | 0.02 | 0.98 | 0.010 | 0.005 | 0.030 | Ca = 0.008 |
| F-21 | 0.1500 | 0.03 | 0.99 | 0.015 | 0.006 | 0.028 | REM = 0.008 |
| F-22 | 0.1600 | 0.01 | 0.96 | 0.013 | 0.004 | 0.025 | Mg = 0.001 |

TABLE 12

| Steel No. | Yield strength [MPa] Before laser treatment | After laser treatment | Gain in strength | Tensile strength [MPa] Before laser treatment | After laser treatment | Gain in strength | Yeild ratio [1%] Before laser treatment | Elongation [%] Before laser treatment | $K_1$ | $K_2$ | Micro-structure | Remark |
|---|---|---|---|---|---|---|---|---|---|---|---|---|
| F-1 | 248.40 | 339.60 | 91.20 | 452.00 | 547.80 | 95.80 | 62.80 | 37.5 | | 0.066 | F + M | Steel of Invention |
| F-2 | 244.80 | 309.40 | 64.60 | 448.40 | 523.30 | 74.90 | 54.59 | 36.8 | 0.032 | 0.032 | F + M | Steel of Invention |

TABLE 12-continued

| Steel No. | Yield strength [MPa] Before laser treatment | Yield strength [MPa] After laser treatment | Yield strength [MPa] Gain in strength | Tensile strength [MPa] Before laser treatment | Tensile strength [MPa] After laser treatment | Tensile strength [MPa] Gain in strength | Yeild ratio [1%] Before laser treatment | Elongation [%] Before laser treatment | $K_1$ | $K_2$ | Micro-structure | Remark |
|---|---|---|---|---|---|---|---|---|---|---|---|---|
| F-3 | 308.72 | 389.32 | 80.60 | 499.60 | 572.80 | 73.20 | 61.79 | 35.6 | 0.076 | 0.076 | F + M | Steel of Invention |
| F-4 | 326.96 | 409.13 | 82.17 | 505.80 | 573.20 | 76.20 | 64.64 | 33.9 | 0.066 | 0.066 | F + M | Steel of Invention |
| F-5 | 287.93 | 371.87 | 83.94 | 503.80 | 580.00 | 76.20 | 57.15 | 34.2 | | 0.090 | F + M | Steel of Invention |
| F-6 | 304.50 | 384.80 | 80.30 | 495.60 | 573.00 | 77.40 | 61.44 | 36.4 | 0.018 | 0.018 | F + M | Steel of Invention |
| F-7 | 208.46 | 227.57 | 19.11 | 371.10 | 412.60 | 41.50 | 56.17 | 39.2 | 0.007 | 0.007 | F + M | Control steel |
| F-8 | 251.20 | 287.34 | 36.14 | 365.80 | 425.60 | 59.80 | 57.46 | 36.0 | 0.009 | 0.009 | F + M | Control steel |
| F-9 | 613.50 | 699.00 | 85.50 | 802.18 | 873.07 | 70.89 | 76.48 | 17.2 | 0.081 | 0.081 | F + M | Steel of Invention |
| F-10 | 575.60 | 759.00 | 168.20 | 814.90 | 917.90 | 103.00 | 70.63 | 17.0 | 0.245 | 0.245 | F + M | Steel of Invention |
| F-11 | 255.80 | 363.08 | 107.28 | 478.60 | 592.00 | 113.40 | 53.45 | 38.2 | | 0.122 | F + M | Steel of Invention |
| F-12 | 405.90 | 506.80 | 100.90 | 550.80 | 647.70 | 96.90 | 63.69 | 31.2 | 0.123 | 0.123 | F + M | Steel of Invention |
| F-13 | 418.40 | 530.90 | 112.50 | 567.30 | 683.50 | 116.20 | 73.75 | 32.7 | | 0.122 | F + M | Steel of Invention |
| F-14 | 481.76 | 592.14 | 110.98 | 632.30 | 738.40 | 106.10 | 76.19 | 26.8 | 0.131 | 0.131 | F + M | Steel of Invention |
| F-15 | 573.81 | 737.61 | 163.80 | 792.58 | 936.80 | 144.22 | 72.40 | 19.4 | 0.224 | 0.224 | F + M | Steel of Invention |
| F-16 | 550.54 | 699.14 | 148.60 | 786.30 | 942.80 | 156.50 | 70.02 | 19.8 | | 0.224 | F + M | Steel of Invention |
| F-17 | 547.30 | 671.20 | 124.20 | 752.10 | 845.30 | 93.20 | 72.77 | 20.10 | 0.145 | 0.145 | F + M | Steel of Invention |
| F-18 | 551.20 | 670.60 | 119.40 | 753.80 | 844.00 | 90.00 | 73.12 | 21.00 | 0.130 | 0.130 | F + M | Steel of Invention |
| F-19 | 558.70 | 676.30 | 119.40 | 764.80 | 862.60 | 97.80 | 73.05 | 19.40 | | 0.106 | F + M | Steel of Invention |
| F-20 | 563.50 | 672.20 | 108.70 | 748.60 | 843.50 | 94.90 | 75.27 | 19.70 | 0.148 | 0.148 | F + M | Steel of Invention |
| F-21 | 560.20 | 669.60 | 109.40 | 746.20 | 833.90 | 87.70 | 75.07 | 20.50 | 0.150 | 0.150 | F + M | Steel of Invention |
| F-22 | 528.70 | 642.60 | 113.90 | 749.50 | 839.40 | 89.90 | 70.54 | 20.30 | 0.154 | 0.154 | F + M | Steel of Invention |

NO sufficient enhancement of strength was realized in (F-7) because of a low C content and in (F-8) because of a low Mn content.

What we claim:

1. A process for enhancing strength of a high-formability steel, comprising the step of:

irradiating said high-formability steel with high density energy allowing formation of a solidified zone, wherein said high-density energy is sufficient to melt through the entire thickness of said high-formability steel, and wherein said high-formability steel comprises C: 0.02–0.3 weight %

Si: not more than 1.5 weight %

Mn: 0.3–2.5 weight %

Fe and unavoidable impurities accounting for the balance and having a microstructure selected from the group consisting of ferrite—bainite, martensite—ferrite and martensite—bainite—ferrite; and wherein said high-formability steel develops high strength characteristics on high-density energy treatment.

2. A process for enhancing strength of a high-formability steel according to claim 1, wherein a $K_1$ value of said high-formability steel given by the equation $K_1$=(Mn weight %+0.25.Si weight %)×C weight % is not less than 0.1.

3. A process for enhancing strength of a high-formability steel according to claim 1, wherein said high-formability steel further comprises at least one of Cr: not more than 2.5 weight %

Mo: not more than 1.0 weight %

B: not more than 50 ppm by weight as an alloying element and wherein a $K_2$ value given by the equation $K_2$=(Mn weight %+Cr weight %+Mo weight %+250.B weight %+0.25.Si weight %)×C weight % is not less than 0.1.

4. A process for enhancing strength of a high-formability steel according to claim 1, wherein said high-formability steel further comprises at least one of Cu: not more than 2.5 weight %

Ni: not more than 1.5 weight %

P: not more than 0.15 weight %

Nb: not more than 0.2 weight %

Ti: not more than 0.2 weight %

Zr: not more than 0.1 weight %

V: not more than 0.1 weight %

W: not more than 0.1 weight % as an alloying element.

5. A process for enhancing strength of a high-formability steel according to claim 1, wherein said high-formability steel is galvanized steel.

6. A process for enhancing strength of a high-formability steel, comprising the step of:

irradiating said high-formability steel with high-density energy allowing formation of a solidified zone, wherein said high-density energy is sufficient to melt through the entire thickness of said high-formability steel, and wherein said high-formability steel comprises:

C: 0.02–0.3 weight %

Si: not more than 1.5 weight %

Mn: not more than 2.5 weight %

Fe and unavoidable impurities accounting for the balance, wherein said high-formability steel has a $K_1$ value computed by the equation $K_1$=(Mn weight %+0.25.Si weight %)×C weight % of not less than 0.01 and a perlite and/or cementite phase being coexistent with the ferrite phase and wherein said high-formability steel develops high strength characteristics on high-density energy treatment.

7. A process for enhancing strength of a high-formability steel according to claim 6, wherein the $K_1$ value is not less than 0.05.

8. A process for enhancing strength of a high-formability steel according to claim 6, wherein said high-formability steel further comprises at least one of:

Cr: not more than 2.5 weight %

Mo: not more than 1.0 weight %

B: not more than 50 ppm by weight as an alloying element and said high-formability steel has a $K_2$ value calculated by the equation $K_2$=(Mn weight %+Cr weight %+Mo weight %+250.B weight %+0.25.Si weight %)×C weight % of not less than 0.05.

9. A process for enhancing strength of a high-formability steel according to claim 6, wherein said high-formability steel further comprises at least one of:

Cu: not more than 2.5 weight %,

Ni: not more than 1.5 weight %,

P: not more than 0.15 weight %,

Nb: not more than 0.2 weight %,

Ti: not more than 0.2 weight %,

Zr: not more than 0.1 weight %,

V: not more than 0.1 weight %,

W: not more than 0.1 weight %, as an alloying element.

10. A process for enhancing strength of a high-formability steel according to claim 1, wherein said high-density energy is a laser.

11. A process for enhancing strength of a high-formability steel according to claim 1, wherein said high-density energy is a laser.

12. A process for enhancing strength of a high-formability steel according to claim 1, wherein said high-density energy is a plasma.

13. A process for enhancing strength of a high-formability steel according to claim 6, wherein said high-density energy is a plasma.

14. A process for enhancing strength of a high-formability steel according to claim 1, wherein said high-density energy has a density of not less than 100 J/mm$^2$.

15. A process for enhancing strength of a high-formability steel according to claim 6, wherein said high-density energy has a density of not less than 100 J/mm$^2$.

16. A process for enhancing strength of a high-formability steel according to claim 6, wherein said high-formability steel is galvanized steel.

17. A process for enhancing strength of a high-formability steel, comprising the step of:

irradiating said high-formability steel with high density energy allowing formation of a solidified zone, wherein said high-density energy is sufficient to melt through the entire thickness of said high-formability steel, and wherein said high-formability steel comprises C: 0.002–0.02 weight %

Si: not more than 2.0 weight %

Mn: 0.1–2.5 weight %

Fe and unavoidable impurities accounting for the balance and has a ferrite-predominant structure and wherein said high-formability steel develops high strength characteristics on high-density energy treatment.

18. A process for enhancing strength of a high-formability steel according to claim 17, wherein said high-formability steel further comprising at least one of Ti: not more than 0.1 weight %

Nb: not more than 0.1 weight % as an alloying element.

19. A process for enhancing the strength of a high-formability steel according to claim 17, wherein said high-formability steel further comprises at least one of P: 0.06–0.2 weight %

B: not more than 50 ppm by weight, with a T value given by the equation T=(Mn weight %+20.P weight %+250.B weight %+0.25.Si weight %)×C weight % of not less than 0.01.

20. A process for enhancing the strength of a high-formability steel according to claim 17, wherein said high-formability comprises C: 0.005–0.02 weight %

Si: not more than 2.0 weight %

Mn: 1.2–2.5 weight %

P: 0.06–0.2 weight %

B: not more than 50 ppm by weight and further comprises at least one of

Ti: 0.01–0.1 weight %

Nb: 0.005–0.1 weight %, with a T value calculated by the equation T=(Mn weight %+20.P weight %+250.B weight %+0.25.Si weight %)×C weight % of not less than 0.01.

21. A process for enhancing the strength of a high-formability steel according to claim 17, wherein said high-formability steel further comprising at least one of Cu: not more than 2.5 weight %

Ni: not more than 1.5 weight %

Cr: not more than 2.5 weight %

Mo: not more than 1.0 weight %

P: not more than 0.15 weight %

B: not more than 50 ppm by weight

Nb: not more than 0.1 weight %

Ti: not more than 0.1 weight %

Zr: not more than 0.1 weight %

V: not more than 0.1 weight %

W: not more than 0.1 weight % as an alloying element.

22. A process for enhancing the strength of a high-formability steel according to claim 18, wherein said high-formability steel further comprises at least one of Cu: not more than 2.5 weight %

Ni: not more than 1.5 weight %

Cr: not more than 2.5 weight %

Mo: not more than 1.0 weight %

P: not more than 0.15 weight %

B: not more than 50 ppm by weight

Zr: not more than 0.1 weight %

V: not more than 0.1 weight %

W: not more than 0.1 weight % as an alloying element.

23. A process for enhancing strength of a high-formability steel according to claim 17, wherein said high-formability steel is galvanized steel.

24. A process for enhancing strength of a high-formability steel, comprising the step of:

irradiating said high-formability steel with high-density energy allowing formation of a solidified zone, wherein said high-density energy is sufficient to melt through the entire thickness of said high-formability steel, and wherein said high-formability steel comprises C: 0.05–0.25 weight %

Si: not more than 3.0 weight %

Mn: 1.1–3.0 weight %

Fe and unavoidable impurities accounting for the balance and has a structure comprising at least one of martensite and bainite microstructures, in addition to ferrite and residual austenite phases and wherein said high-formability steel develops high strength characteristics on high-density energy treatment.

25. A process for enhancing strength of a high-formability steel according to claim 24, wherein said high-formability steel has a $K_1$ value computed by the equation $K_1$=(Mn weight %+0.25.Si weight %)+C weight % of not less than 0.35.

26. A process for enhancing strength of a high-formability steel according to claim 24, wherein said high-formability steel further comprises at least one of Cr: not more than 2.5 weight %

Mo: not more than 1.0 weight %

B: not more than 50 ppm by weight, with said $K_2$ value being not less than 0.35.

27. A process for enhancing strength of a high-formability steel according to claim 24, wherein said high-formability steel further comprising at least one of Cu: not more than 2.5 weight %

Ni: not more than 1.5 weight %

P: not more than 0.15 weight %

Nb: not more than 0.2 weight %

Ti: not more than 0.2 weight %

Zr: not more than 0.1 weight %

V: not more than 0.1 weight %

W: not more than 0.1 weight % as an alloying element.

28. A process for enhancing strength of a high-formability steel according to claim 17, wherein said high-density energy is a laser.

29. A process for enhancing strength of a high-formability steel according to claim 17, wherein said high-density energy is a plasma.

30. A process for enhancing strength of a high-formability steel according to claim 17, wherein said high-density energy has a density of not less than 100 J/mm$^2$.

31. A process for enhancing strength of a high-formability steel according to claim 24, wherein said high-density energy is a laser.

32. A process for enhancing strength of a high-formability steel according to claim 24, wherein said high-density energy is a plasma.

33. A process for enhancing strength of a high-formability steel according to claim 24, wherein said high-density energy has a density of not less than 100 J/mm$^2$.

34. A process for enhancing strength of a high-formability steel according to claim 24, wherein said high-formability steel is galvanized steel.

* * * * *

UNITED STATES PATENT AND TRADEMARK OFFICE

CERTIFICATE OF CORRECTION

PATENT NO. : 5,529,646

DATED : June 25, 1996

INVENTOR(S) : Hiroki NAKAJIMA, et al.

It is certified that error appears in the above-indentified patent and that said Letters Patent is hereby corrected as shown below:

On the title page, Item [54], the Title, should read:

-- [54] PROCESS OF PRODUCING HIGH-FORMABILITY STEEL PLATE WITH A GREAT POTENTIAL FOR STRENGTH ENHANCEMENT BY HIGH-DENSITY ENERGY TREATMENT --

Signed and Sealed this

Twenty-fourth Day of September, 1996

*Attest:*

Bruce Lehman

BRUCE LEHMAN

*Attesting Officer*

*Commissioner of Patents and Trademarks*